US011712610B1

(12) United States Patent
Joseph et al.

(10) Patent No.: US 11,712,610 B1
(45) Date of Patent: Aug. 1, 2023

(54) ULTRASONIC SHOTS-MADE DETECTOR FOR BASKETBALL LAUNCHING DEVICE

(71) Applicant: Shoot-A-Way, Inc., Upper Sandusky, OH (US)

(72) Inventors: John Joseph, Upper Sandusky, OH (US); Albert Abnett, Nevada, OH (US)

(73) Assignee: SHOOT-A-WAY, INC., Upper Sandusky, OH (US)

( * ) Notice: Subject to any disclaimer, the term of this patent is extended or adjusted under 35 U.S.C. 154(b) by 0 days.

(21) Appl. No.: 18/095,567

(22) Filed: Jan. 11, 2023

(51) Int. Cl.

| | |
|---|---|
| ***A63B 69/40*** | (2006.01) |
| ***A63B 69/00*** | (2006.01) |
| ***A63B 71/06*** | (2006.01) |

(52) U.S. Cl.
CPC ..... *A63B 69/40* (2013.01); *A63B 69/0071* (2013.01); *A63B 71/0619* (2013.01); *A63B 71/0669* (2013.01); *A63B 2069/401* (2013.01); *A63B 2071/0655* (2013.01); *A63B 2220/802* (2013.01); *A63B 2220/833* (2013.01); *A63B 2225/50* (2013.01)

(58) Field of Classification Search
CPC . A63B 69/40; A63B 69/0071; A63B 71/0619; A63B 71/0669; A63B 2069/401; A63B 2071/0655; A63B 2220/802; A63B 2220/833; A63B 2225/50
See application file for complete search history.

(56) References Cited

U.S. PATENT DOCUMENTS

| | | | |
|---|---|---|---|
| 435,964 | A | 9/1890 | Compton |
| 1,223,386 | A | 4/1917 | Handelan |
| 2,650,585 | A | 9/1953 | Farre, Jr. |
| 2,655,908 | A | 10/1953 | Calleo |

(Continued)

FOREIGN PATENT DOCUMENTS

| | | |
|---|---|---|
| CN | 303127130 | 3/2015 |
| CN | 303207615 | 5/2015 |

(Continued)

OTHER PUBLICATIONS

The Gun 6000 Series, Shoot-A-Way, Inc. Upper Sandusky, Ohio, http://www.shootaway.com/Gun1.htm/, at least as early as Jun. 2000.

(Continued)

*Primary Examiner* — Jeffrey S Vanderveen
(74) *Attorney, Agent, or Firm* — Standley Law Group LLP; Jeffrey S. Standley; Adam J. Smith

(57) ABSTRACT

Detectors and related systems and methods for automatically detecting made and missed basketball shots using ultrasonics are provided. A launcher is connected to a structural subassembly and passes basketballs to locations about a basketball playing area having a basketball goal. A detector having at least one ultrasonic sensor is selectively positioned below and adjacent to a rim of the basketball goal and transmits bursts of ultrasonic signals. A processor monitors for reflections of the transmitted bursts occurring within a specified time period after transmission excluding an initial time period and time after the specified time period, and (Continued)

records a made shot where reflections of the transmitted bursts are detected within the specified time period. An accelerometer may optionally be included for determining if the made shot was a swish.

21 Claims, 17 Drawing Sheets

(56) References Cited

U.S. PATENT DOCUMENTS

| | | | |
|---|---|---|---|
| 2,696,204 | A | 12/1954 | Gilgoff |
| D174,027 | S | 2/1955 | Farkas |
| 2,908,266 | A | 10/1959 | Cooper |
| D204,309 | S | 4/1966 | Murray |
| 3,776,550 | A | 12/1973 | McNabb |
| 3,802,703 | A | 4/1974 | Van Tassel |
| 3,878,828 | A | 4/1975 | Francesco |
| 4,168,695 | A | 9/1979 | Haller et al. |
| 4,262,648 | A | 4/1981 | Wegener et al. |
| 4,269,163 | A | 5/1981 | Feith |
| 4,391,264 | A | 7/1983 | Abraham et al. |
| 4,471,746 | A | 9/1984 | Ando |
| 4,579,340 | A | 4/1986 | Jenkins et al. |
| 4,611,571 | A | 9/1986 | Tressler et al. |
| D287,854 | S | 1/1987 | Crews |
| 4,667,957 | A | 5/1987 | Joseph |
| 4,678,189 | A | 7/1987 | Koss |
| 4,714,248 | A | 12/1987 | Koss |
| 4,717,149 | A | 1/1988 | Juhl |
| 4,913,431 | A | 4/1990 | Jakobs |
| 4,936,577 | A | 6/1990 | Kington et al. |
| 4,940,231 | A | 7/1990 | Ehler |
| 4,955,605 | A | 9/1990 | Goldfarb |
| 4,995,371 | A | 2/1991 | Kuizinas |
| 5,016,875 | A | 5/1991 | Joseph |
| 5,039,977 | A | 8/1991 | Mele et al. |
| 5,121,735 | A | 6/1992 | Hancock |
| 5,125,651 | A | 6/1992 | Keeling et al. |
| 5,312,099 | A | 5/1994 | Oliver, Sr. |
| 5,342,041 | A | 8/1994 | Aguinek et al. |
| 5,365,427 | A | 11/1994 | Soignet et al. |
| 5,393,049 | A | 2/1995 | Nelson |
| 5,409,211 | A | 4/1995 | Adamek |
| 5,417,196 | A | 5/1995 | Morrison et al. |
| 5,418,517 | A | 5/1995 | Matheme et al. |
| 5,450,540 | A | 9/1995 | Spohrer et al. |
| 5,540,428 | A | 7/1996 | Joseph |
| 5,562,282 | A | 10/1996 | Stevenson |
| 5,619,977 | A | 4/1997 | Gatin |
| 5,647,747 | A | 7/1997 | Macri et al. |
| 5,676,120 | A | 10/1997 | Joseph |
| 5,681,230 | A | 10/1997 | Krings |
| 5,746,668 | A | 5/1998 | Ochs |
| 5,768,151 | A | 6/1998 | Lowy et al. |
| 5,776,018 | A | 7/1998 | Simpson et al. |
| 5,813,926 | A | 9/1998 | Vance |
| 5,816,953 | A | 10/1998 | Cleveland |
| 5,842,699 | A | 12/1998 | Mirando et al. |
| 5,911,214 | A | 6/1999 | Andrews |
| 6,224,503 | B1 | 5/2001 | Joseph |
| 6,241,628 | B1 | 6/2001 | Jenkins |
| D445,426 | S | 7/2001 | Wang et al. |
| 6,280,352 | B1 | 8/2001 | Coffeen et al. |
| 6,389,368 | B1 | 5/2002 | Hampton |
| 6,659,893 | B1 | 12/2003 | Campbell et al. |
| 6,707,487 | B1 | 3/2004 | Aman et al. |
| 6,715,478 | B1 | 4/2004 | Tanner |
| 6,731,316 | B2 | 5/2004 | Herigstad et al. |
| 6,746,397 | B2 | 6/2004 | Lee et al. |
| 6,918,591 | B2 | 7/2005 | D'Amico et al. |
| 7,094,164 | B2 | 8/2006 | Marty et al. |
| 7,111,620 | B2 | 9/2006 | Johndreau et al. |
| D554,661 | S | 11/2007 | Hoover et al. |
| D554,662 | S | 11/2007 | Hoover et al. |
| D591,305 | S | 4/2009 | Shimoda |
| 7,620,466 | B2 | 11/2009 | Neale et al. |
| 7,802,699 | B1 | 9/2010 | Hoy |
| 7,850,552 | B2 | 12/2010 | Marty et al. |
| 7,854,669 | B2 | 12/2010 | Marty et al. |
| 7,882,831 | B2 | 2/2011 | Alger |
| 7,927,237 | B2 | 4/2011 | Jenkins et al. |
| D637,199 | S | 5/2011 | Brinda et al. |
| 7,938,746 | B2 | 5/2011 | Chipperfield |
| 8,012,046 | B2 | 9/2011 | Campbell et al. |
| 8,016,687 | B2 | 9/2011 | Martin et al. |
| 8,123,634 | B1 | 2/2012 | Lovett |
| 8,133,137 | B2 | 3/2012 | Grant et al. |
| 8,147,356 | B2 | 4/2012 | Campbell et al. |
| 8,206,246 | B2 | 6/2012 | Joseph et al. |
| 8,286,619 | B2 | 10/2012 | Mihaljevic |
| 8,408,982 | B2 | 4/2013 | Marty et al. |
| 8,409,024 | B2 | 4/2013 | Marty et al. |
| D681,662 | S | 5/2013 | Fletcher et al. |
| D687,845 | S | 8/2013 | Lee |
| 8,540,560 | B2 | 9/2013 | Crowley et al. |
| D690,728 | S | 10/2013 | Brinda |
| 8,579,632 | B2 | 11/2013 | Crowley |
| 8,617,008 | B2 | 12/2013 | Marty et al. |
| 8,622,832 | B2 | 1/2014 | Marty et al. |
| D704,734 | S | 5/2014 | Wafapoor |
| 8,727,784 | B1 | 5/2014 | Wolf |
| D714,321 | S | 9/2014 | Pereira |
| D714,325 | S | 9/2014 | Pereira |
| 8,852,030 | B2 | 10/2014 | Campbell et al. |
| 8,854,457 | B2 | 10/2014 | De Vleeschouwer et al. |
| 8,908,922 | B2 | 12/2014 | Marty et al. |
| 8,948,457 | B2 | 2/2015 | Marty et al. |
| 9,010,309 | B2 | 4/2015 | Lewis et al. |
| 9,015,627 | B2 | 4/2015 | Lai |
| 9,017,188 | B2 | 4/2015 | Joseph et al. |
| D729,488 | S | 5/2015 | Pulskamp et al. |
| 9,086,257 | B2 | 7/2015 | Laporte et al. |
| D737,278 | S | 8/2015 | Shin et al. |
| D739,488 | S | 9/2015 | Campbell et al. |
| D745,533 | S | 12/2015 | Luo |
| D746,855 | S | 1/2016 | Choi |
| 9,233,292 | B2 | 1/2016 | Joseph et al. |
| 9,238,164 | B2 | 1/2016 | Perry, Jr. |
| 9,238,165 | B2 | 1/2016 | Marty et al. |
| 9,248,368 | B2 | 2/2016 | Stimac |
| 9,254,432 | B2 | 2/2016 | Ianni et al. |
| 9,283,431 | B2 | 3/2016 | Marty et al. |
| 9,283,432 | B2 | 3/2016 | Marty et al. |
| 9,345,929 | B2 | 5/2016 | Marty et al. |
| 9,358,455 | B2 | 6/2016 | Marty et al. |
| 9,370,704 | B2 | 6/2016 | Marty |
| D760,769 | S | 7/2016 | Ishii et al. |
| D761,840 | S | 7/2016 | Patterson et al. |
| 9,390,501 | B2 | 7/2016 | Marty et al. |
| D762,709 | S | 8/2016 | Hsieh |
| D767,596 | S | 9/2016 | Shi |
| 9,452,339 | B1 | 9/2016 | Shah et al. |
| D768,143 | S | 10/2016 | Drozd et al. |
| D768,148 | S | 10/2016 | Jung et al. |
| 9,474,953 | B1 | 10/2016 | Duke |
| D774,518 | S | 12/2016 | Lv |
| D776,676 | S | 1/2017 | Shi |
| D778,314 | S | 2/2017 | Li et al. |
| D783,659 | S | 4/2017 | Park |
| D786,269 | S | 5/2017 | Lin et al. |
| 9,656,140 | B2 | 5/2017 | Thurman et al. |
| D789,393 | S | 6/2017 | Jaini et al. |
| D790,585 | S | 6/2017 | Kim et al. |
| 9,687,713 | B1 | 6/2017 | Duke |
| D791,786 | S | 7/2017 | Chauhri et al. |
| 9,694,238 | B2 | 7/2017 | Marty et al. |
| 9,697,617 | B2 | 7/2017 | Marty et al. |
| 9,724,584 | B1 | 8/2017 | Campbell et al. |
| 9,734,405 | B2 | 8/2017 | Marty et al. |
| 9,808,696 | B2 | 11/2017 | Campbell et al. |
| D808,976 | S | 1/2018 | Shi |
| 9,886,624 | B1 | 2/2018 | Marty et al. |
| 9,914,035 | B2 | 3/2018 | Campbell et al. |

(56) References Cited

U.S. PATENT DOCUMENTS

| | | | |
|---|---|---|---|
| D817,348 | S | 5/2018 | Ishikawa et al. |
| D818,488 | S | 5/2018 | Frazier |
| 9,975,026 | B2 | 5/2018 | Campbell et al. |
| 10,004,949 | B2 | 6/2018 | Brothers et al. |
| 10,010,778 | B2 | 7/2018 | Marty et al. |
| D824,955 | S | 8/2018 | Lee et al. |
| 10,092,793 | B1 | 10/2018 | Marty et al. |
| D838,729 | S | 1/2019 | Guerrier et al. |
| 10,252,128 | B2 | 4/2019 | Lewis et al. |
| 10,252,133 | B2 | 4/2019 | Campbell et al. |
| 10,315,090 | B2 | 6/2019 | Campbell et al. |
| 10,343,015 | B2 | 7/2019 | Marty et al. |
| 10,360,685 | B2 | 7/2019 | Marty et al. |
| D861,720 | S | 10/2019 | Koller et al. |
| 10,471,325 | B2 | 11/2019 | Marty et al. |
| 10,489,656 | B2 | 11/2019 | Lee et al. |
| 10,537,780 | B2 | 1/2020 | Joseph et al. |
| 10,561,916 | B1 | 2/2020 | Campbell et al. |
| 10,596,436 | B1 | 3/2020 | Campbell et al. |
| 10,600,334 | B1 | 3/2020 | Zhang et al. |
| 10,603,568 | B2 | 3/2020 | Palanethra et al. |
| 10,610,757 | B1 | 4/2020 | Marty |
| 10,688,362 | B1 | 6/2020 | Sangalang |
| 10,762,642 | B2 | 9/2020 | Marty et al. |
| 10,806,986 | B2 | 10/2020 | Moore et al. |
| 10,898,782 | B2 | 1/2021 | Circosta |
| 10,994,182 | B1 | 5/2021 | Campbell et al. |
| 11,077,353 | B1 | 8/2021 | Kamstra et al. |
| 11,097,176 | B1 | 8/2021 | Campbell et al. |
| 11,123,605 | B1 | 9/2021 | Marty |
| 11,135,500 | B1 | 10/2021 | Campbell et al. |
| 11,247,109 | B1 | 2/2022 | Campbell et al. |
| 11,247,111 | B2 | 2/2022 | Harvey, Jr. et al. |
| 11,380,100 | B2 | 7/2022 | Lee et al. |
| 11,491,383 | B1 | 11/2022 | Campbell et al. |
| 2002/0010032 | A1 | 1/2002 | Stiteler |
| 2003/0023145 | A1 | 1/2003 | Lee et al. |
| 2005/0143154 | A1 | 6/2005 | Bush |
| 2006/0068945 | A1 | 3/2006 | Murchison, III |
| 2006/0160639 | A1 | 7/2006 | Klein |
| 2006/0236993 | A1 | 10/2006 | Cucjen et al. |
| 2007/0026974 | A1 | 2/2007 | Marty et al. |
| 2007/0026975 | A1 | 2/2007 | Marty et al. |
| 2007/0173355 | A1 | 7/2007 | Klein |
| 2007/0232419 | A1 | 10/2007 | Kosjer |
| 2007/0265138 | A1 | 11/2007 | Ashby |
| 2008/0015061 | A1 | 1/2008 | Klein |
| 2008/0200287 | A1 | 8/2008 | Marty et al. |
| 2008/0254866 | A1 | 10/2008 | Young et al. |
| 2008/0261726 | A1 | 10/2008 | Chipperfield |
| 2008/0312010 | A1 | 12/2008 | Marty et al. |
| 2009/0042672 | A1 | 2/2009 | Radice |
| 2009/0045578 | A1 | 2/2009 | Wang |
| 2009/0137347 | A1 | 5/2009 | Jenkins et al. |
| 2010/0259412 | A1 | 10/2010 | Pagonakis |
| 2010/0261557 | A1 | 10/2010 | Joseph et al. |
| 2011/0013087 | A1 | 1/2011 | House et al. |
| 2011/0071818 | A1 | 3/2011 | Jiang |
| 2011/0214651 | A1 | 9/2011 | Woessner et al. |
| 2011/0294585 | A1 | 12/2011 | Penna et al. |
| 2011/0303207 | A1 | 12/2011 | Shober et al. |
| 2012/0115651 | A1 | 5/2012 | Chipperfield |
| 2012/0322587 | A1 | 12/2012 | Duke |
| 2013/0095959 | A1 | 4/2013 | Marty et al. |
| 2013/0130845 | A1 | 5/2013 | Marty et al. |
| 2013/0172058 | A1 | 7/2013 | Marty et al. |
| 2014/0092253 | A1 | 4/2014 | Marty et al. |
| 2014/0121043 | A1 | 5/2014 | Blanning |
| 2014/0135956 | A1 | 5/2014 | Thurman et al. |
| 2014/0195019 | A1 | 7/2014 | Thurman et al. |
| 2014/0195022 | A1 | 7/2014 | Thurman et al. |
| 2014/0200692 | A1 | 7/2014 | Thurman et al. |
| 2014/0222177 | A1 | 8/2014 | Thurman et al. |
| 2014/0266160 | A1 | 9/2014 | Coza |
| 2014/0283142 | A1 | 9/2014 | Shepherd et al. |
| 2014/0301601 | A1 | 10/2014 | Marty et al. |
| 2014/0305420 | A1 | 10/2014 | Deese |
| 2014/0344698 | A1 | 11/2014 | Hohteri et al. |
| 2015/0028541 | A1 | 1/2015 | Murakami et al. |
| 2015/0131845 | A1 | 5/2015 | Forouhar et al. |
| 2015/0141144 | A1 | 5/2015 | Sprague et al. |
| 2015/0258416 | A1 | 9/2015 | Ianni et al. |
| 2015/0265897 | A1 | 9/2015 | Gordon et al. |
| 2015/0290516 | A1 | 10/2015 | Joseph et al. |
| 2015/0352425 | A1 | 12/2015 | Lewis et al. |
| 2015/0382076 | A1 | 12/2015 | Davisson et al. |
| 2016/0082340 | A1 | 3/2016 | Adams |
| 2016/0121193 | A1 | 5/2016 | Marty et al. |
| 2016/0166907 | A1 | 6/2016 | Joseph et al. |
| 2016/0193518 | A1 | 7/2016 | Baxter et al. |
| 2016/0193520 | A1 | 7/2016 | Hart |
| 2016/0250536 | A1 | 9/2016 | Hart |
| 2016/0250540 | A1 | 9/2016 | Joseph et al. |
| 2016/0287964 | A1 | 10/2016 | Jones |
| 2016/0310814 | A1 | 10/2016 | Joseph et al. |
| 2016/0325168 | A1 | 11/2016 | Campbell et al. |
| 2016/0354664 | A1 | 12/2016 | De Carlo |
| 2017/0007921 | A1 | 1/2017 | Baba et al. |
| 2017/0095716 | A1 | 4/2017 | Lewis et al. |
| 2017/0136333 | A1 | 5/2017 | Joseph et al. |
| 2017/0157482 | A1 | 6/2017 | DeCarlo |
| 2017/0161561 | A1 | 6/2017 | Marty et al. |
| 2017/0232298 | A1 | 8/2017 | Joseph et al. |
| 2017/0282044 | A1 | 10/2017 | Moore et al. |
| 2017/0340943 | A1 | 11/2017 | Pierotti et al. |
| 2017/0340949 | A1 | 11/2017 | Tsai |
| 2017/0368425 | A1* | 12/2017 | Gordon ..... A63B 71/0605 |
| 2018/0056124 | A1 | 3/2018 | Marty et al. |
| 2018/0099201 | A1 | 4/2018 | Marty et al. |
| 2018/0322337 | A1 | 11/2018 | Marty et al. |
| 2019/0087661 | A1 | 3/2019 | Lee et al. |
| 2019/0224555 | A1 | 7/2019 | Ward |
| 2019/0329114 | A1 | 10/2019 | Marty et al. |
| 2020/0098113 | A1 | 3/2020 | Marty et al. |
| 2020/0364462 | A1 | 11/2020 | Imes |
| 2021/0370152 | A1* | 12/2021 | Gordon ..... A63B 71/0669 |
| 2022/0122269 | A1 | 4/2022 | Marty et al. |
| 2022/0212077 | A1 | 7/2022 | Anton et al. |
| 2022/0288451 | A1 | 9/2022 | Hebbale et al. |

FOREIGN PATENT DOCUMENTS

| | | | |
|---|---|---|---|
| EP | 2271414 | B1 | 6/2014 |
| RU | 2026104 | | 1/1995 |
| WO | 9530872 | A1 | 11/1995 |
| WO | 9532033 | | 11/1995 |
| WO | 2005062841 | | 7/2005 |
| WO | 2009126982 | A2 | 10/2009 |

OTHER PUBLICATIONS

Dr. Dish™, Airborne Athletics Inc., Belle Plaine, Minnesota, http://www.drdishbasketball.com/, at least as early as Jul. 29, 2003.

Make™, Airborne Athletics Inc., Belle Plaine, Minnesota, www.imakebasketball.com. (The iMake has a menu drive programming board allowing the user to select a shooting range by selecting a left and a right limit. The user is given he ability to select spots between said shooting range in spaced increments for the machine to fire balls in that direction.) At least as early as Jun. 2008.

Vorelco, The Sniper Basketball Training System, https://www.youtube.com/watch?v=X9SqMy8xdf4, Uploaded on Jul. 5, 2008.

Brochure entitled "Sniper: The Ultimate Basketball Trainer." before Oct. 22, 1995, 5 pages including the cover letter.

ECoach, Learn From the Best Minds in Basketball and Grow Your Game, https://ecoachsports.com/basketball-old/, site accessed Aug. 28, 2019.

Sideline Scout, SideLine Live, https://sidelinescout.com/sports/basketball/, site accessed Aug. 28, 2019.

White, J., Technology Grows and Coaches Need to Grow With [It]: Remote Training Gives High School Athletes a Different Outlet, USA Today High School Sports, https://usatodayhss.com/2019/

(56) References Cited

OTHER PUBLICATIONS technology-grows-and-coaches-need-to-grow-with-it-remote-training-gives-high-school-athletes-a-different-outlet, Jul. 4, 2019.
HomeCourt, https://www.homecourt.ai/, site accessed Aug. 28, 2019.
Airborne Athletics, Inc., www.imakebasketball.com/training_features.html, Jun. 2008, visited Feb. 3, 2016 via http://web.archive.com/web/20080608033916/http://www.imakebasketball.com/training_features.html.
Airborne Athletics, Inc., www.airborneathletics.com/imake-basketball-machine.php, Feb. 2011, visited Feb. 3, 2016 via http://web.archive.org/web/20110213020947http://www.airbomeathletics.com/imake-basketball-machine.php.
Airborne Athletics, Inc., www.drdishbasketball.com, visited Mar. 1, 2016.
Airborne Athletics, Inc., Dr. Dish Display, Available Apr. 2015.
Control Panel shown on webpage: https://web.archive.org/web/2013011040129/https://www.winners-choice.net/gun-8000.html, Web Archive Capture date: Oct. 11, 2013 (accessed on Feb. 24, 2018) (Year: 2013).
Shoot-A-Way, Inc., www.shootaway.com, visited Mar. 1, 2016.
Dr. Dish Owner's Manual, Airborne Athletics, Inc., 2005.
Reich, B. et al., A Spatial Analysis of Basketball Shot Chart Data, the American Statistician, Feb. 2006, vol. 60 No. 1.
Sniper, First Advanced Basketball Training Device, 2009.
BSN Sports, Hot Shot Basketball Shooting Machine, https://www.bsnsports.com/hot-shot-basketball-shooting-machine site accessed Mar. 9, 2021.
Myom, Myom Basketball Shooting Gun Basketball Rebounder Machine—Best Basketball Shooting Trainer, https://www.amazon.com/MYOM-Basketball-Shooting-Rebounder-Machine/dp/B07HBN5X81, site accessed Mar. 9, 2021.
Siboasi, Basketball Passing Machine S6839, https://www.siboasi.com/basketball-passing-machine-s6839.html, site accessed Mar. 9, 2021.
Siboasi, Siboasi S6839 Programmable Basketball Shooting Machine, https://www.youtube.com/watch?v=ZjzTnaLOccY&t=16s, Jun. 1, 2019.

* cited by examiner

ULTRASONIC SHOTS-MADE DETECTOR FOR BASKETBALL LAUNCHING DEVICE

CROSS-REFERENCE TO RELATED APPLICATIONS

This application is filed as original and makes no priority claim.

TECHNICAL FIELD

Exemplary embodiments relate generally to a shots-made detector for a basketball launching device which utilizes ultrasonics, and related systems and methods.

BACKGROUND AND SUMMARY OF THE INVENTION

Basketball return machines exist which assist a basketball player by returning made shots, and usually at least some missed shots, to the player such that the player does not have to spend time retrieving the basketballs. This way, the player is able to fit more shots into a given practice session. Some basketball return machines use a guide or track to direct basketballs towards a player. Other basketball return machines use launching devices to eject basketballs in various directions on a playing area. Exemplary basketball return machines include, without limitation, THE GUN machines available from Shoot-A-Way, Inc. of Upper Sandusky, Ohio (shootaway.com/) and DR. DISH machines available from Airborne Athletics, Inc. of Minneapolis, Minn. (www.drdishbasketball.com/).

In order to provide the player with feedback regarding his or her shooting performance during a given practice session, detection devices are sometimes used to monitor the player's performance. Such detection devices may take the form of flappers which are placed along the route a basketball would take during or after passing through the rim and are physically moved or contacted when a basketball moves along such a route, thus indicating a successfully made shot. Such devices are subject to physical wear, jamming, and may disrupt the basketball's travel. Other exemplary detection devices include photo-eyes. Such photo-eyes may be mounted in close proximity to a basketball hoop and monitor for changes in the ambient light created when a basketball passes through the hoop. Such photo-eyes are subject to inaccurate readings due to changes in ambient lighting conditions which may be caused, for example, by the net shifting in front of the photo-eye, reflections, flash photographs, or lights being turned on or off. Additionally, all of the above detection devices may be difficult to appropriately position in relation to the basketball goal.

An improved made-shots detector is disclosed which utilizes ultrasonics. In exemplary embodiments, without limitation, accelerometer data is also used to determine if a made shot is a "swish" or not, statistics for which may be separately recorded. As used herein, the term swishes may refer to a made basketball shot which does not touch, or substantially impact, a rim of a basketball goal. The detector may be used in conjunction with a basketball launching device.

The detector may comprise one or more ultrasonic sensors, data from which may be received at one or more processors, such as microprocessors, to detect made and/or missed basketball shots. In exemplary embodiments, without limitation, the detector may be connectable to, or otherwise securable adjacent to, a basketball rim or backboard.

For example, without limitation, the detector may comprise one or more housings for the ultrasonic sensors. The housing(s) may comprise, or be attached to, a bracket. The bracket may be configured for selective securement to a basketball goal, such as at, over, to, or at least partially about a bracket connecting a basketball hoop to a backboard. In this fashion, the ultrasonic sensors may be suspended at a position below and adjacent to the rim, such as next to any net hung from the rim. The housing(s) and/or bracket may be permanently or temporarily attached to a pole, such as a telescoping pole, for mounting and removal from the basketball goal.

Each of the ultrasonic sensors may comprise multiple transmitters and receivers may be utilized. The multiple transmitters and receivers may be utilized and/or paired in various fashions (e.g., transmitter 1 with receiver 1, transmitter 2 with receiver 2, transmitter 1 with receiver 2, transmitter 2 with receiver 1, etc.). Various utilizations and/or pairings may occur during a given sensing episode to provide and/or confirm determinations of made or missed shots. Detected return signals at certain time periods of a given sensing episode may be ignored, such as to eliminate false positive signals reflected from a near or far net portion.

Where return signals during a sensing episode are returned at the appropriate time intervals, a made shot may be determined. Where no such return signals are received, a missed shot may be recorded. The sensing episode may begin and end during a predetermined time range following issuance of a command to pass a basketball from the launching device.

In exemplary embodiments, without limitation, the detector may comprise one or more accelerometers. Data from the accelerometer(s) may be fed to the processor(s) to determine if a made-shot is a swish. The accelerometer(s) may be attached, directly or indirectly, to one or more of the housing(s) such that movement and/or vibrations are transmitted to the accelerometer(s), such as upon impact of a basketball at the backboard and/or rim. Alternatively, or additionally, the accelerometer(s) may be attached, directly or indirectly, to the rim, backboard, or other portion of the basketball goal.

Where data from the ultrasonic sensor(s) indicates a made shot, and movement data received from the accelerometer(s) within an associated time period is below a predetermined threshold, the detector may register a swish. This may reflect a lack of jarring of the basketball goal caused when the basketball from a shooting attempt travels through the rim without touching or otherwise substantially impacting the rim, backboard, or other portion of the goal. Where data from the ultrasonic sensor(s) indicates a made shot, and movement data received from the accelerometer(s) within an associated time period is above the predetermined threshold, the detector may register a regular made-shot. This may reflect jarring of the basketball goal caused when the basketball from a shooting attempt first strikes the rim, backboard, or other portion of the goal.

A performance report may be generated comprising percentages of successfully made shots for each pass receipt location the basketballs were ejected and/or shooting location where shots were taken. The performance report may comprise a rendering which may substantially match the rendering on the interface. The percentages of successfully made shots may be provided on the rendering of the performance report at the pass receipt location and/or the shooting locations the basketballs were ejected to so that a user can quickly asses their areas of strength and weakness. The performance report may separately indicate swish shots, such as overall and/or at each pass receipt location.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
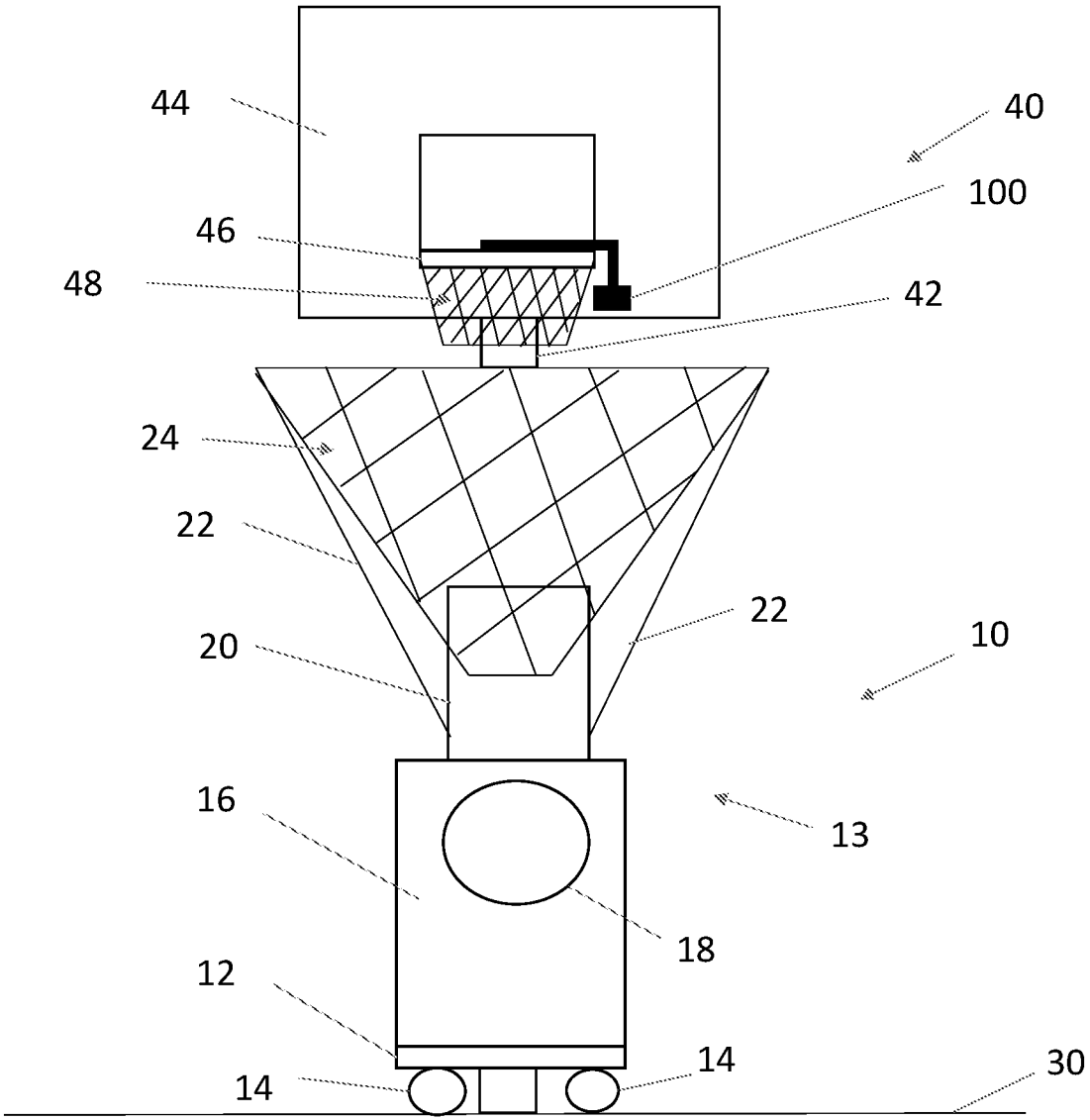
FIG. 1 is a front view of an exemplary basketball launching device having an ultrasonics-based detection system in accordance with the present invention located near a basketball goal on a playing area.
Figure 2:
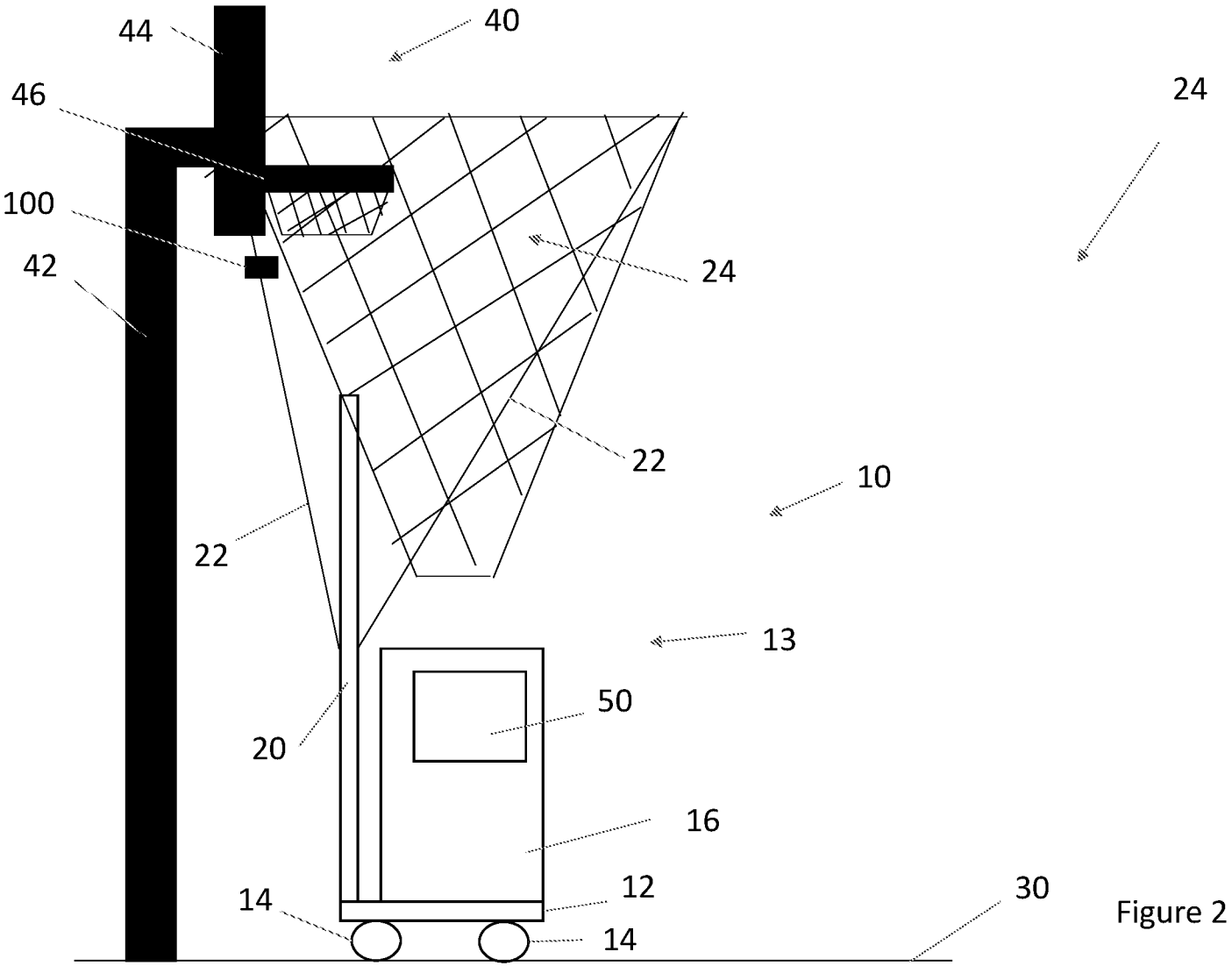
FIG. 2 is a side view of the FIG. 1A device with another exemplary embodiment of the detector.

FIG. 1 is a front view of an exemplary basketball launching device 10 and FIG. 2 is a side view of the basketball launching device 10. The basketball launching device 10 may comprise a support structure 12. The support structure 12 may comprise a frame, platform, rigid members, combinations thereof, or the like. One or more wheels 14 may be mounted to the support structure 12 which permit movement of the basketball launching device 10 around a playing area 30. A housing 16 may be mounted to the support structure 12. The housing 16, in exemplary embodiments, may be mounted to the support structure 12 in a rotatable manner. One or more apertures 18 may be located in the housing 16. At least a first one of the apertures 18 may be sized to permit basketballs 60 to be ejected therethrough to various pass receipt locations at the playing area 30. The first one of the apertures 18 may be located on a front of the housing 16, though any location may be utilized. A second one of the apertures 18 may be located on an upper portion of the housing 16 and may be sized to permit the basketballs to enter the housing 16 through the second one of the apertures 18. In other exemplary embodiments, the housing 16 is not required or is provided outside the travel path of the basketball.

The support structure 12 may comprise a frame 20, at least a portion of which may extend vertically. At least a portion of the frame 20 may be collapsible, though such is not required. The frame 20 may comprise one or more support members 22. At least some of said support members 22 may be adjustable in length. In exemplary embodiments, at least some of the support members 22 may comprise telescoping poles. In exemplary embodiments, four support members 22 may extend upwardly and outwardly from the support structure 12 in a splayed fashion, though any number and configuration of support members 22 may be utilized. The support member 22 may, in exemplary embodiments, be selectively collapsible.

A net 24 may be attached to one or more of the support members 22. Openings in the net 24 may be sized to prevent the basketballs 60 from passing therethrough. The net 24 may be configured to create a funnel shape when mounted to said support members 22 such that basketballs 60 gathered in the net 24 are directed towards the housing 16 where they may be received through one or more openings, such as but not limited to, the second one of the apertures 18. However, any size, shape, and type of net 24 may be utilized. Alternatively, or in addition, one or more guide tracks may extend between the bottom of the net 24 and the housing 16.

The basketball launching device 10 may be placed in proximity to a basketball goal 40 by a user, such as directly below a rim 46 of the goal 40. However, the device 10 may optionally be placed elsewhere about a playing area.

The basketball goal 40 may be regulation type, height, size and configuration, though such is not required. The basketball goal 40 may comprise a post 42 which extends to the playing area 30, a backboard 44, the rim 46, and a net 48, for example without limitation. For example, without limitation, the rim 46 may be positioned 10 feet above the playing area 30.

Some or all of the frame 20 may be adjustable. For example, without limitation, the frame 20 may comprise one or more mechanisms for collapsing the support members 22, the net 24, and/or the frame 20. In this way, the basketball launching device 10 may be selectively reduced in size. In exemplary embodiments, the basketball launching device 10 may be sufficiently reduced in size so as to fit through a standard size doorway, though such is not required. As another example, without limitation, the frame 20 may comprise one or more mechanisms for expanding the support members 22, the net 24, and/or the frame 20. In this way, the basketball launching device 10 may be selectively increased in size. In exemplary embodiments, the basketball launching device 10 may be positioned and sufficiently increased in size such that one or more upper edges of the net 24 extend above the rim 46 of the basketball goal 40 when so positioned. When expanded, the net 24 may create a sufficiently sized top opening to accommodate most, or all, of a user's made shots as well as at least some, or all, of the user's missed shots, which are gathered by the net 24 and returned to the housing 16.

In still other exemplary embodiments, adjustment of the net 24 may be achieved by adjustment of the support members 22, with or without adjustment of the frame 20. FIG. 1 illustrates an exemplary configuration of the basketball launching device 10 with the net 24 positioned below the rim 46 and FIG. 2 illustrates an exemplary configuration of the basketball launching device 10 with the net 24 positioned above the rim 46 of the basketball goal 40. Any height of the net 24 in a collapsed and/or expanded position may be utilized.

The support structure 12, the housing 16, the support poles 22, and/or the frame 20 may, at least in part, define a structural subassembly 13. The structural subassembly 13 may comprise one or more of the support structure 12, the housing 16, the support poles 22, and/or the frame 20. The term structural subassembly 13 may therefore refer to such components, or subcomponents thereof, collectively or individually.

An interface 50 may be provided for receiving user input and/or displaying information. The interface 50 may comprise one or more physically depressible buttons, electronic icons capable of direct or indirect selection, one or more electronic displays, one or more touch screens, combinations thereof, or the like. The interface 50 may be connected to the frame 20. Alternatively, the interface 50 may be mounted to the housing 16 or other component of the basketball launching machine 10. Any size, shape, or location of the interface 50 may be utilized. Alternatively, or additionally, the interface 50 may be provided on one or more personal electronic devices 70 such as, but not limited to, a smartphone, a tablet, a personal computer, some combination thereof, or the like. Such personal electronic devices 70 may be physically separate from the basketball launching machine 10 or physically integrated therewith. For example, without limitation, the personal electronic devices 70 may be permanently mounted to one or more components of the basketball launching machine 10. In other exemplary embodiments, the personal electronic devices 70 may be configured for selective and/or temporary mounting to the frame 20, housing 16, or other component of the basketball launching machine 10 such as, but not limited to, by way of a holder or mounting device.

As further described herein, the device 10 may comprise one or more detectors 100 for detecting made and/or missed basketball shots. The detector(s) 100 may be connected to the device 10, such as mounted to the support members 22 or other portions of the structural subassembly 13, though such is not required. In other exemplary embodiments, without limitation, the detector(s) 100 may be attachable to portions of the basketball goal 40. The detector(s) 100 may be in wired or wireless connection with components of the device 10. The detector(s) 100 may be physically separate, or separable, from a remainder of the device 10.

Figure 3:
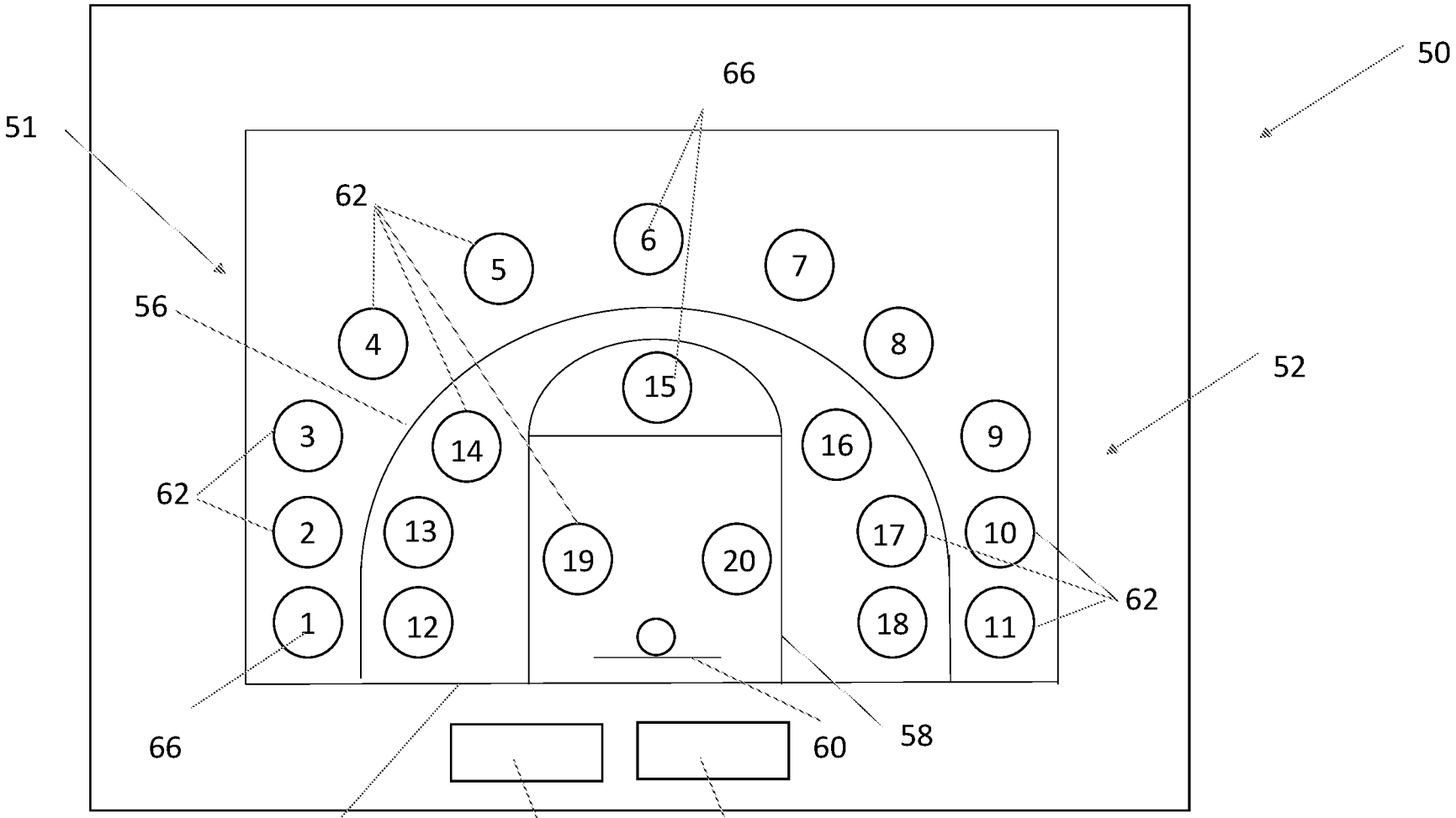
FIG. 3 is a front view of an exemplary location selection display.

FIG. 3 is a detailed view of the interface 50 with an exemplary location selection display 51. The interface 50 may comprise a rendering, illustration, or other visual depiction 52 of elements of an exemplary playing area 30, such as but not limited to a regulation basketball court. The visual depiction 52 may comprise, for example without limitation, depictions of a baseline, a key, a three-point arc, a basketball goal, combinations thereof, or the like. Any size, shape, arrangement, type, or kind of such basketball playing area elements or regulation or non-regulation type playing areas may be provided as part of the visual depiction 52 on the interface 50.

The location selection display 51 may comprise a number of selectable areas 62. The selectable areas 62 may be located at various positions on the visual depiction 52 to correlate with pass receipt positions on the playing area 30. The selectable areas 62 may be selected by the user to create custom shooting arrangements. The selectable areas 62, in exemplary embodiments, may be visually depicted as indicia such as but not limited to a circle though any size, shape, color, type, or the like of such selectable areas 62 may be utilized.

In exemplary embodiments, the interface 50 may comprise a touch screen. In such embodiments, the visual depiction 52 may be electronically generated electronic icons at the touch screen. The selectable areas 62, in such embodiments, may already be visible on the interface 50, such as in the form of indicia or icons, and may change when selected. In other such embodiments, the selectable area 62, such as in the form of indicia or icons, may not be visible and may become visible when the corresponding area of the interface 50 is selected. Such selection may be performed by direct, individual, physical contact, though such is not required. The touch screen may comprise a resistive, capacitive, or other type of touch screen. Some or all of the selectable areas 62 may be physically and/or electrically separated from one another or may be part of an undivided touch screen, display, panel, or the like.

In other exemplary embodiments, the interface 50 may comprise an electronic display. In such embodiments, the visual depiction 52 may be electronically generated on the electronic display. The selectable areas 62, in such embodiments, may already be visible on the interface 50, such as in the form of indicia or icons, and may change when selected. Such selection may be performed by one or more selection devices 64. Such selection devices 64 may permit interaction with the images displayed on the electronic display. For example, without limitation, such selection devices 64 may comprise a keypad, mouse, buttons, arrows, some combination thereof, or the like. The electronic display may comprise an LCD, cathode ray, OLED, plasma, or other type of electronic display.

In still other exemplary embodiments, the interface 50 may comprise a static panel. In such embodiments, the visual depiction 52 may be painted, printed, integrally formed, or otherwise provided on the interface 50 in a permanent or semi-permanent fashion. The selectable areas 62, in such embodiments, may comprise buttons. The selectable areas 62 may comprise illumination devices or the like which are configured to indicate whether the selectable areas 62 have been selected by a user. Such selection may be performed by direct, individual, physical contact, though such is not required.

Once selected, the selected ones of the selectable areas 62 may be changed, such as by illumination, highlighting, color changes, appearance, disappearance, shape change, number or other indication change, filled in, combinations thereof, or the like.

The selectable areas 62 may be provided at various locations on the visual depiction 52. The selectable areas 62 may be circular in shape, though any size and shape selectable areas 62 may be utilized. The selectable areas 62 may be located at spaced angular positions along the visual depiction 52. For example, without limitation, a number of selectable areas 62 may be positioned on or along the visual depiction of the three-point arc 56. In exemplary embodiments, some of the selectable areas 62 may be located inside the three-point arc 56 and other selectable areas 62 may be located outside of the three-point arc 56, though such is not required. Alternatively, or in addition, some or all of the selectable areas 62 may be located within or around the visual depiction of the key 58. The selectable areas 62 may, alternatively or additionally, be provided in visual correlation to a visual depiction of a baseline 54. Any size, shape, number, or arrangement of selectable areas 62 may be utilized.

Each of the selectable areas 62 may comprise one or more markers 66. The markers 66 may comprise numbers, letter, symbols, some combination thereof or the like. The markers 66 may provide nomenclature for the selectable areas 62 as well as the corresponding shooting positions on the playing area. The interface 50 may be configured to monitor for, and/or receive, a user selection of one or more of the selectable areas 62 to create a custom basketball practice arrangement. The selectable areas 62 may be individually selected by physical touch in a direct or indirect manner. The selectable areas 62 may form input locations for receiving user input.

Alternatively or in addition to the embodiments described herein, a number of predetermined sets of selectable areas 62 may be preprogrammed to define pre-made practice arrangements. Such pre-made practice arrangements may be made available by way of certain ones of said selectable areas 62. In such embodiments, the interface 50 may be configured to permit the user to select one or more such predetermined programs as an alternative to, or in addition to, creating a custom practice arrangement.

The selectable areas 62 may be arranged on the visual depiction 52 to visually correspond with pass receipt locations at the playing area. In this way, the player knows where to stand to receive passes from the basketball launching machine 10 and the player is able to select particular areas to focus on, such as areas of weakness. The selectable area 62 may be provided on a 1:1 basis with such pass receipt locations, though any ratio may be utilized.

The interface 50 may comprise one or more areas 67 for selecting additional options such as, but not limited to, a time delay between passes, a number of basketballs per location, and the like. In exemplary embodiments, the separate area(s) 67 may not be required and such options may be selected at the area with the visual depiction 52. The areas 67 may be part of the interface 50, or be separate therefrom. The areas 67, for example without limitation, may comprise further selectable areas of a touch screen, icons on an electronic display, dedicated button(s), combinations thereof, of the like.

Figure 4:
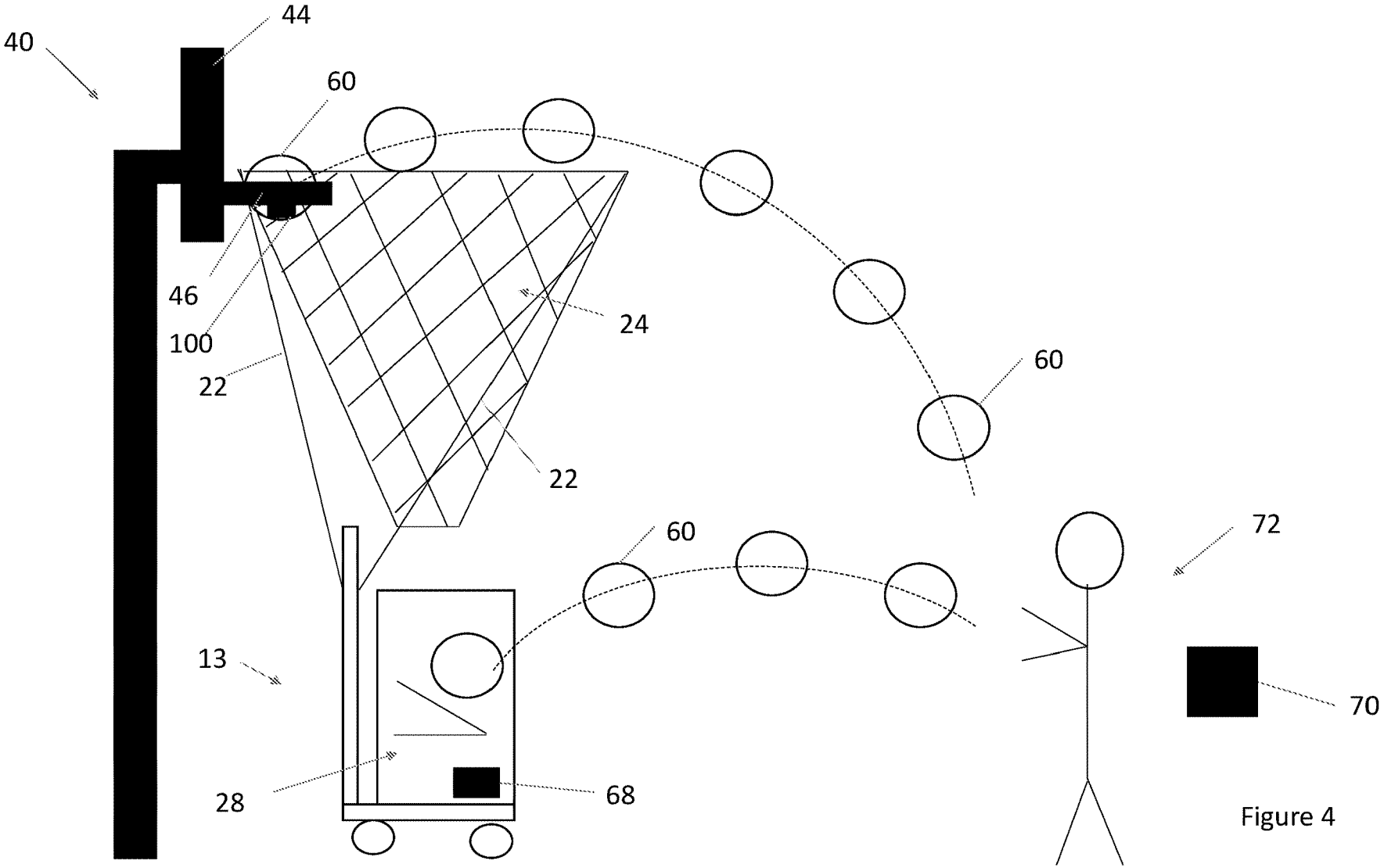
FIG. 4 is a side view of the basketball launching device with certain elements of the basketball launching device removed to illustrate additional components, exemplary basketballs are also illustrated.

FIG. 4 is a side view of the basketball launching device 10 with certain elements of the housing 16 removed to illustrate the launcher 28. The launcher 28 may be configured to launch one or more basketballs 60 to one or more pass receipt locations at the playing area 30 for a player 72 to catch and shoot towards the basketball goal 40. For example, without limitation, the launching device 28 may comprise a catapult arm, thrower, wheeled device, pneumatic device, some combination thereof, or the like. Any kind or type of launching device 28 may be utilized. The launcher 28 may be mounted to the housing 16 and/or the support structure 12 in a rotatable manner, though such is not required.

The interface 50 may be placed in electronic communication with a controller 68. The controller 68 may be located at the housing 16, though any location of the controller 68 may be utilized, including but not limited to at a remote location such as a server and/or personal electronic device 70. The controller 68 may comprise one or more electronic storage devices with executable software instructions and one or more processors. Alternatively, or in addition, the controller 68 may be part of one or more other components of the basketball launching device 10 including but not limited to, the detector(s) 100 and the interface 50. The controller 68 may be configured to receive electronic signals from the interface 50 regarding the user's selection of the selectable areas 62 to form a custom practice arrangement and may program the launcher 28 to pass basketballs 60 to each of the pass receipt locations at the playing area 30 corresponding to each of selectable areas 62 selected by the user at the interface 50 to perform the custom practice arrangement. The controller 68 may be configured to, alternatively or additionally, receive input from the interface 50 including user selection of the selection devices 64, area 67, pre-programmed drill, user preferences, other options, some combination thereof, or the like and program the launcher 28 and/or display such user selections at the interface 50 in accordance with the received input.

The basketball launching device 10 may be positioned in proximity to the basketball goal 40 such that the basketballs 60 passing through the rim 46, and at least some of the basketballs 60 bouncing off the backboard 44 but not necessarily passing through the rim 46 or otherwise resulting in a missed shot (i.e., not passing through the rim 46), may be captured in the net 24. The detector(s) 100 may be positioned below and adjacent to the rim 46 in exemplary embodiments, without limitation. In this way, the detector(s) 100 may be configured to detect a presence of any basketballs 60 passing through the rim 46.

Figure 5:
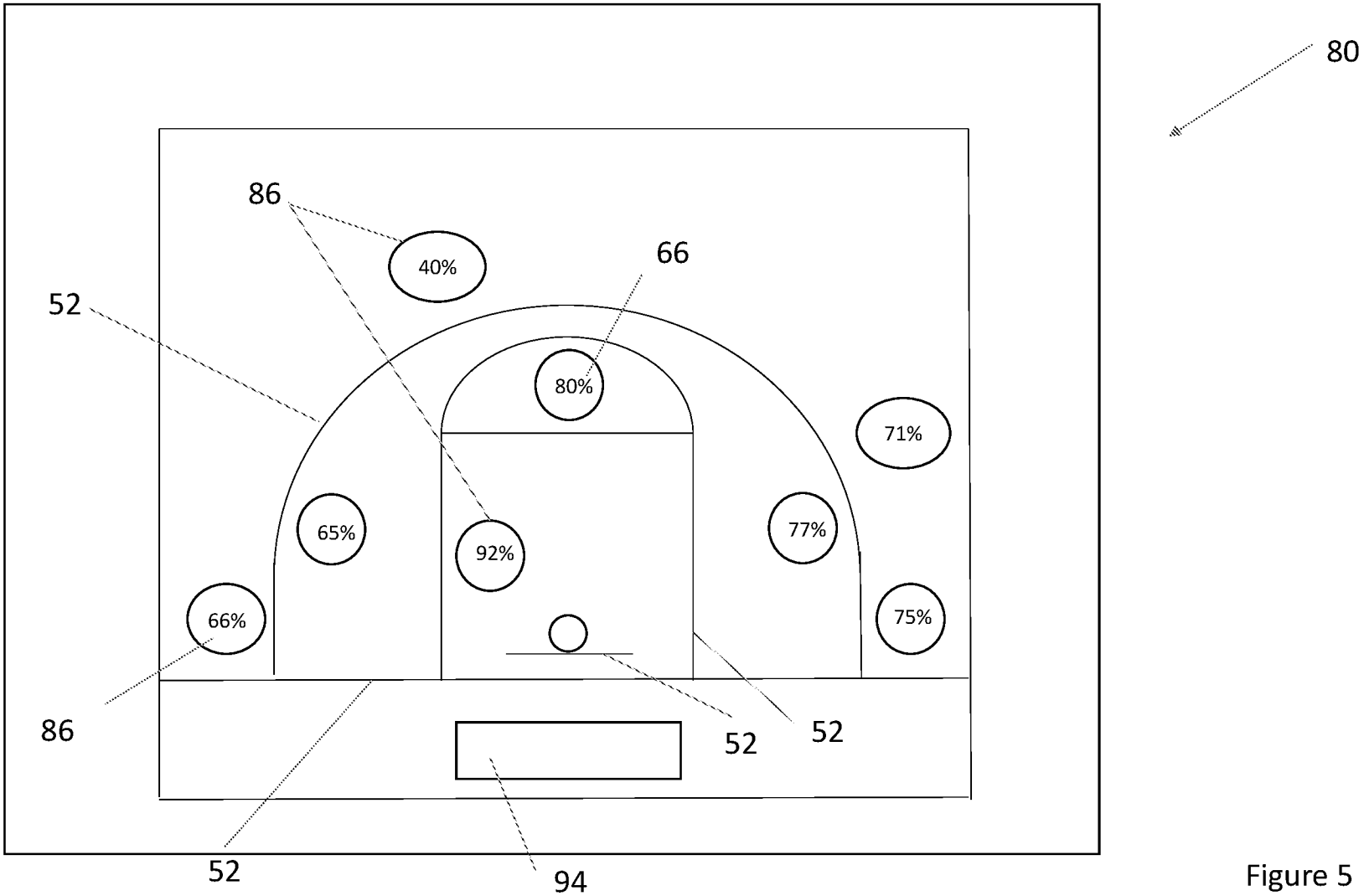
FIG. 5 is a front view of an exemplary performance report.

FIG. 5 illustrates the interface 50 with an exemplary performance report 80 for a given practice session. The report 80 may comprise the same or similar visual depiction 52 of the playing area 30, though such is not required. The visual depiction 52 may be the same or different from the visual depiction 52 provided at other displays, such as but not limited to at the interface 50.

The performance report 80 may comprise shooting feedback 86 located at, and corresponding to, substantially each of the selectable areas 62 forming the practice arrangement. The feedback 86 may by visually depicted with indicia of the same size and shape as the selectable areas 62, though such is not required. For example, without limitation, the feedback 86 may be provided without such indicia, or with different types, color, size, shape, or the like characteristics compared to the selectable areas 62. The feedback 86 may comprise a number of made shots, a number of missed shots, a percentage of made shots, a percentage of missed shots, a grade, a pass/fail indication, swishes information, combinations thereof, or the like. The feedback 86 may be provided in the same or similar form, such as but not limited to, shape, font, color, size, some combination thereof, or the like, as the selectable areas 62. For example, without limitation, the selectable areas 62 and the feedback 86 may comprise circles. In this way, the user may be able to quickly ascertain their strong and weak shooting positions. An overall number and/or percentage of made and/or missed shots, or other information, may be displayed at a second area 94, though such is not required. In exemplary embodiments, such all number and/or percentage of made and/or missed shots, or other information, may, alternatively or additionally, be displayed at a separate display on the basketball launching device 10 or elsewhere.

The performance report 80 may be displayed at the interface 50. The performance report 80 may be generated at the controller 68, the interface 50, the personal electronic device 70, some combination thereof, or the like.

In other exemplary embodiments, the interface 50, and/or various displays thereof, may be provided on the personal electronic device 70 in addition to, or alternatively to, at the basketball launching machine 10. It is notable that the user of the interface 50 may be provided to the basketball player 72 or may be some other individual such as, but not limited to, a friend, parent, coach, assistant, or the like.

Figure 6:
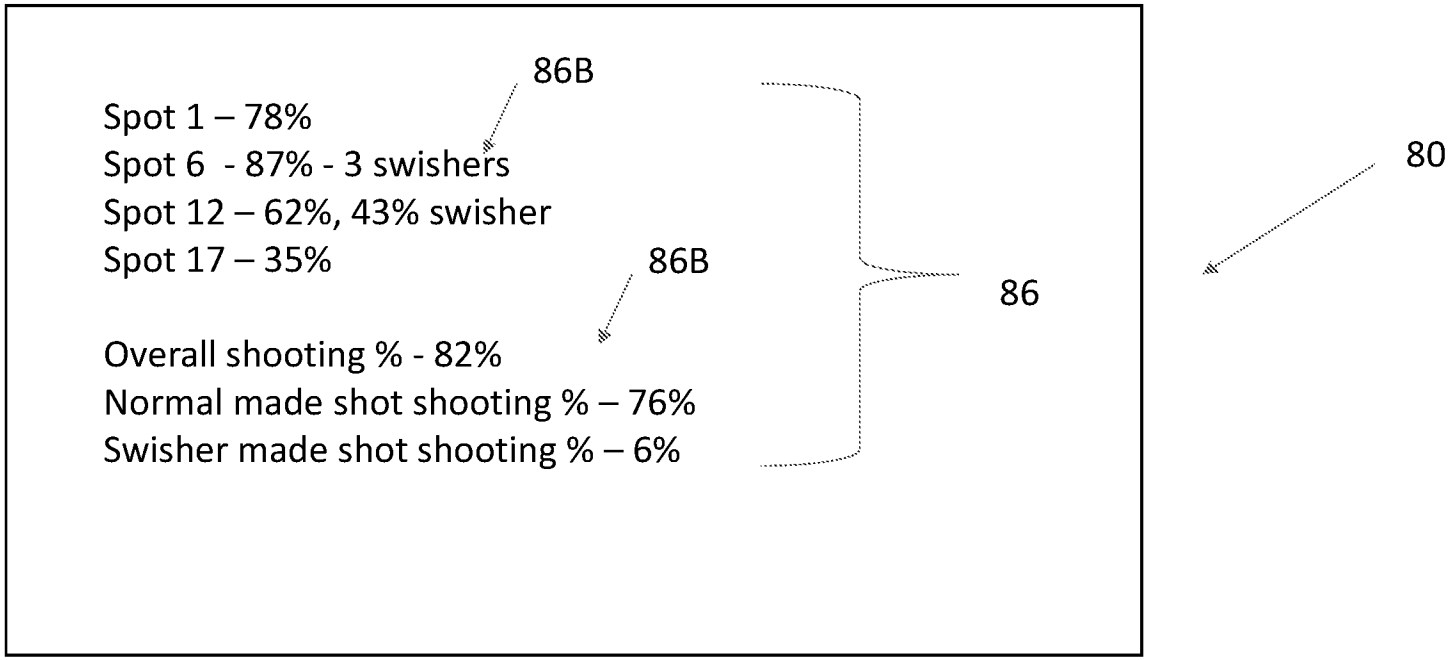
FIG. 6 is front view of another exemplary performance report with off of the dribble shot tracking.

FIG. 6 illustrates another exemplary embodiment of the performance report 80. The performance report 80 may comprise a listing of feedback 86, at least some of which may comprise the swishes information 86B. Such feedback 86 may be provided for individual pass receipt and/or shooting locations selected or provided at the interface 50 and/or overall categorizations of such statistics for one or more shooting sessions, across a team or other group, combinations thereof, or the like. Such feedback 86 may be provided together or separately, such as in listings, a scrolling manner, combinations thereof, or the like.

Figure 7:
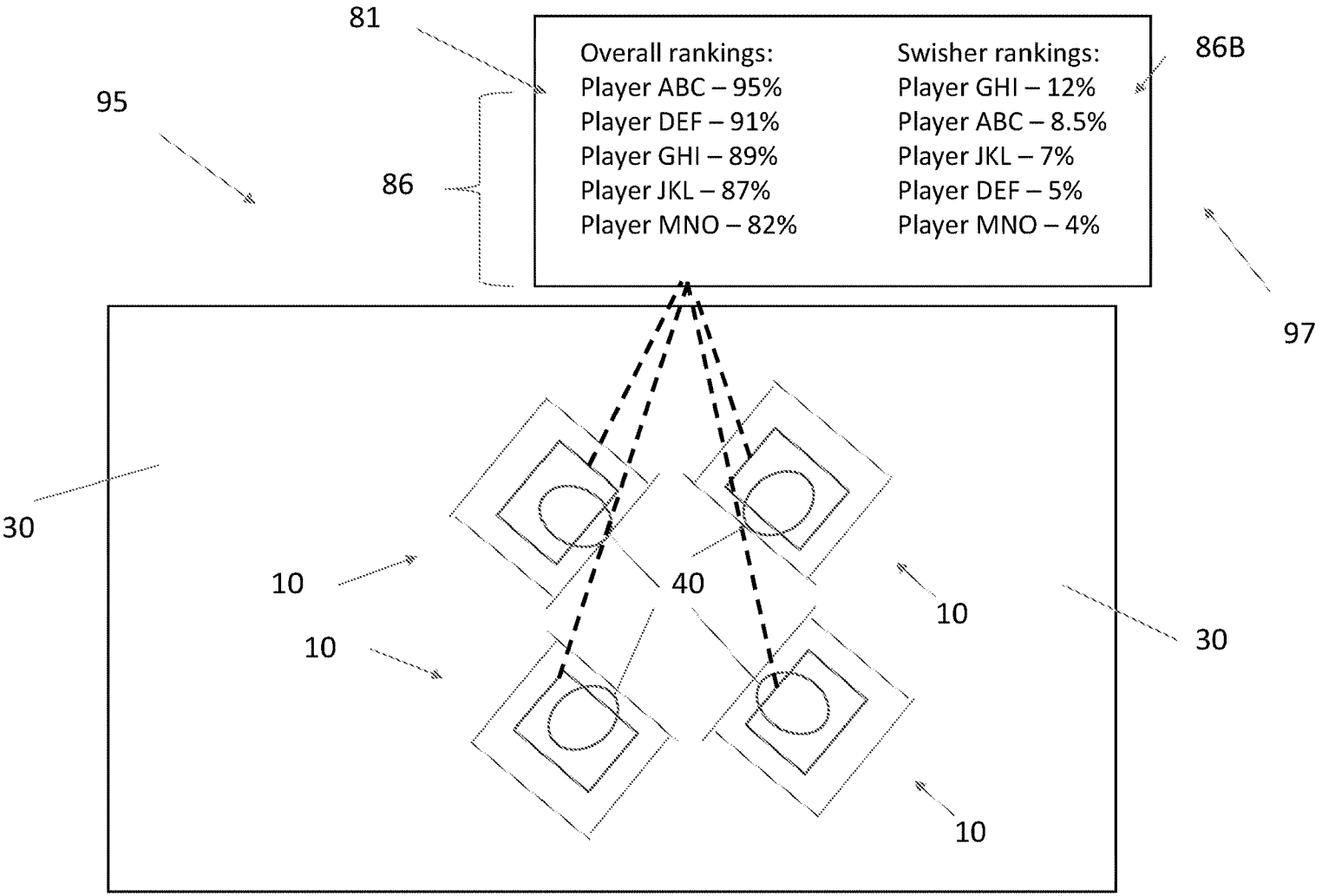
FIG. 7 is a perspective view of an exemplary facility with multiple basketball launching devices and an exemplary scoreboard.
Figure 8:
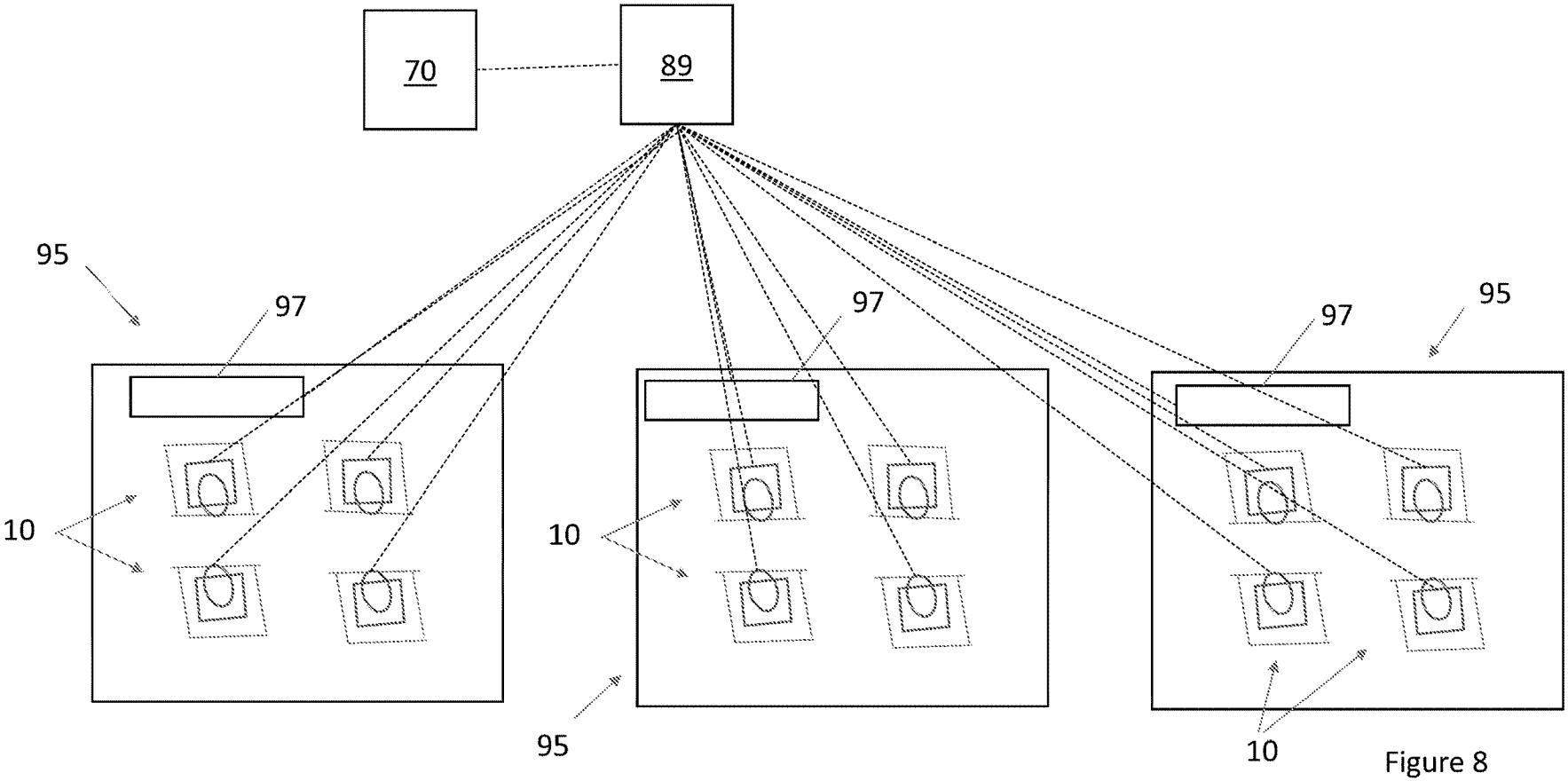
FIG. 8 is a plan view of an exemplary multi-facility competition system in accordance with the present invention.
Figure 9:
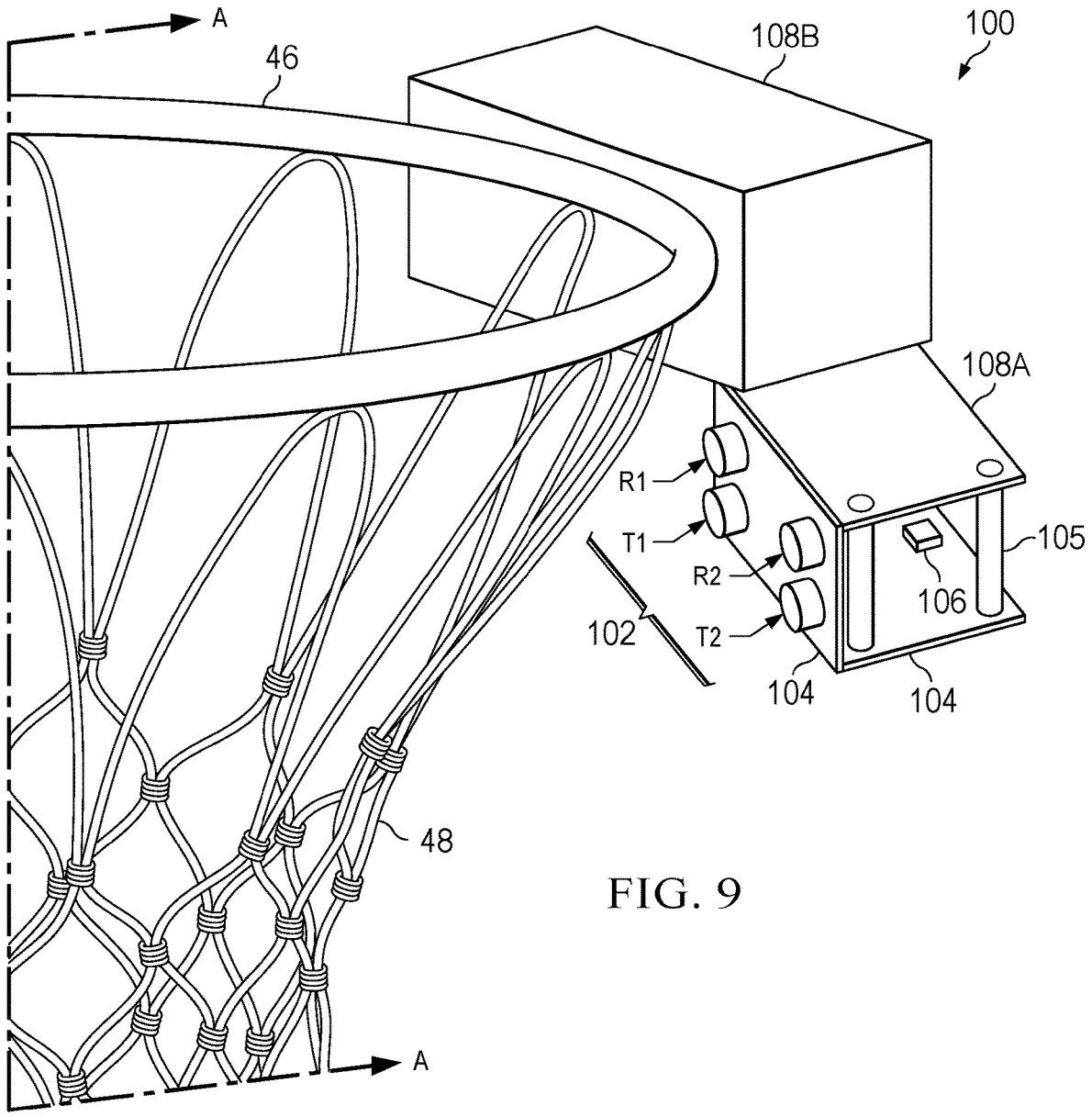
FIG. 9 is a perspective view of an exemplary detector using ultrasonic and accelerometers mounted to an exemplary basketball hoop indicating section line A-A.

FIG. 7 and FIG. 8 illustrate exemplary competition facilitating systems. A facility 95 configured to hold one or more basketball launching machines 10 may be provided. The facility 95 may be a gym, recreation center, school facility, retail location, or any other type of kind space and/or building. The facility 95 may have a ceiling height sufficient to accommodate players shooting basketballs towards the one or more basketball launching machines 10. The facility 95 may have one or more playing surfaces, such as a wooden basketball playing floor with or without regulation or non-regulation playing line markings, configured to facilitate basketball play. One or more basketball launching machines 10 may be provided about the same or different playing areas 30. Each of the basketball launching machines 10 may be associated with a basketball goal 40, though such is not required. Netting, walls, or other dividers may be provided between each of the basketball launching machines 10.

Multiple players may practice at the one or more basketball launching machines 10 at the same or different times. Data may be transmitted from one or more of the basketball launching machines 10, associated personal electronic devices 70, combinations thereof, or the like, wired or wirelessly, to one or more scoreboards 97. The scoreboard(s) 97 may be configured to generate and/or display the performance report 80 in any embodiment, combinations thereof, or the like shown and/or described herein. The scoreboard(s) 97 may be positioned within the facility 95, such as but not limited to, mounted to one or more walls or from a ceiling thereof, in view of some or all of the basketball launching machines 10 and/or detector(s) 100. In exemplary embodiments, the scoreboard(s) 97 are configured to display a ranking 81 of shooting statistics or other feedback 86 for various players in a group, team, or the like. In exemplary embodiments, at least some of the statistics 86 may comprise, or consist of, statistics associated with off of the swish information 86B may be provided indicating the same.

A single interface 50 and/or controller 68 may be used to control each of the basketball launching machines 10. Alternatively, or additionally, a separate interface 50 and/or controller 68 may be provided for each of the basketball launching machines 10. In this way, a common practice routine may be provided to each of the basketball launching machines 10 for a competitive challenge by the single interface 50, or commonly programmed at each machine 10. Alternatively, separate practice routines may be provided for each of the basketball launching machines 10, such as by the single interface 50 or separate interfaces 50.

In exemplary embodiments, the scoreboards 97 may be configured to display feedback 86, such as shooting statistics, from all such basketball launching machines 10 in a given facility 95. The scoreboard 97 may periodically or continuously display feedback 86 for all users of the basketball launching machines 10 within the facility 95, or a subset of such users, such as but not limited to, current users of such machines 10. This may facilitate competition between users of machines 10 of a given facility 95. In other exemplary embodiments, the scoreboards 97 may be configured to display feedback 86 from basketball launching machines 10 in multiple facilities 95. In such embodiments, the statistics displayed may be for all users of all such machines 10 in all such facilities 95, or a subset of such users. This may facilitate competition intra-facility 95 competitions, such as but not limited to, intra-region, intra-conference, intra-state, national, or worldwide competitions. As another example, without limitation, the scoreboard 97 may be configured to display cumulative feedback 86 for all users of all machines 10 at a given facility 95 against all user of all machines 10 at another facility 95, or subsets of such users. This may facilitate intra-facility 95 competitions. In still other embodiments, the scoreboards 97 may be configured to display feedback 86 for select groups of users and/or select machines 10 of select facilities 95. This may facilitate group competitions, such as but not limited to, friends, families, teams, or the like.

The feedback 86 from multiple machines 10 and/or facilities 95 may be gathered at one or more centralized databases 89, though such is not required. Such databases 89 may, alternatively or additionally, be in electronic communication with remote devices 70 such as laptops, smartphones, tablets, servers, combinations thereof, or the like. The centralized databases 89, where utilized, may be in electronic communication with each other and/or the scoreboards 97 of any number of facilities 95. User's may be able to specify relationships with facilities 95, groups (e.g., friends, families, teams, combinations thereof, or the like), regions, conferences, states, nations, combinations thereof, or the like to facilitate such scoring, display, and competition. Such information may be recorded by way of the user interfaces 50, at the databases 89, at remote devices 70, combinations thereof, or the like. A single, central database 89 may be provided for all facilities 95, for example. As another example, a database 89 may be provided for each facility 95 and each of said databases may be in communication with one another 89.

A separate scoreboard 97 may be provided in each facility 95, though such is not required. The individual machines 10, the databases 89, and/or the remote devices 70 may be in electronic communication with one or more of the scoreboards 97 and be configured to command said scoreboards 97 to display the feedback 86, including but not limited to, rankings 81 and swishes information 86B in association with some or all of the displayed feedback 86. The feedback 86 may be displayed in any form or format, including but not limited to, as a ranking 81 and/or the same or similar to some or all of the performance report 80.

The interface 50 and various displays thereof as shown and provided herein, including but not limited to the location selection display 51 and/or the performance report 80 (in any exemplary embodiment shown and/or described herein, combinations thereof, or the like) may be provided at the basketball launching machine 10, the remote personal electronic device 70, the scoreboard 97, combinations thereof, or the like.

The various selection or selectable areas shown and/or described herein, such as but not limited to selection devices 64, areas 67, and/or second area 94, may be separate from, or integrated with, the various displays such as, but not limited to, the visual depiction 52, the location selection display 51, the reports 80, the shooting feedback 86, selectable areas 86, markers 66, combinations thereof, and the like such that such items are provided on a common interface 50, display, touch screen, panel, or the like or on separate displays, touch screens, panels, interfaces 50, or the like.

Mounting or connections shown and/or described herein may be made directly or indirectly (e.g., by intervening members, brackets, combinations thereof, or the like).

FIG. 9 through FIG. 17 illustrate an exemplary detector 100 for use with, or forming part of, the basketball launching device 10, components thereof, and methods for operating the same. The detector 100 may comprise one or more ultrasonic sensors 102, data from which may be received at one or more processors 126 of the detector 100, which may be microprocessors, to detect made and/or missed basketball shots. In exemplary embodiments, without limitation, the detector 100 may comprise two ultrasonic transmitters 114 (labeled T1, T2), and two ultrasonic receivers 116 (labeled R1, R2). The receivers 116 and transmitters 114 may be positioned on opposing sides of a circuit board 104, or other substrate, with the receivers 116 located vertically above the transmitters 114, respectively, as shown with particular regard to at least FIG. 9.

The receives 116 and transmitters 114 may be pointed inward, at least at a relatively small angle (e.g., 15 degrees or less from perpendicular), though such is not necessarily required. Any number, arrangement, and/or type of receivers and transmitters may be utilized. The ultrasonic sensors 102 may act as transceivers. Some or all of the ultrasonic sensors 102 may utilized separate transmitters 114 and receivers 116. Some or all of the ultrasonic sensors 102 may, alternatively or additionally, utilize combined transmitter/receivers.

Figure 10:
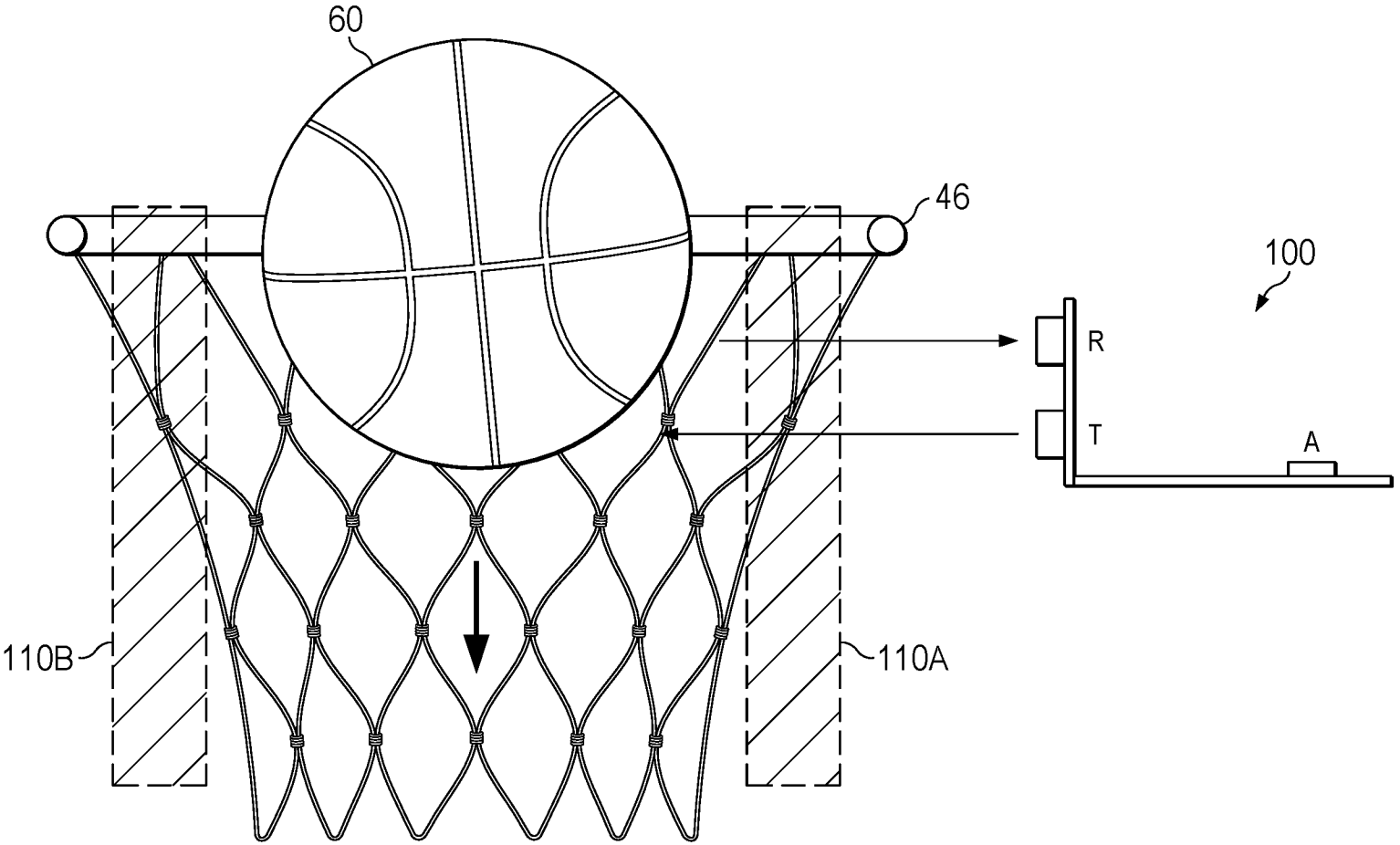
FIG. 10 is a sectional view of the exemplary detector and basketball hoop taken along section line A-A of FIG. 9.

The detector 100 may be connectable to, or otherwise securable adjacent to, the basketball rim 46, the backboard 44, the net 48, or other portion of the basketball goal 40, such as shown with particular regard to at least FIG. 10. For example, without limitation, the detector 100 may comprising a housing subassembly 108, at least a portion of which is configured for selective connection to a bracket extending between the rim 46 and the backboard 44 such that the ultrasonic sensors 102 are positioned outside of, but adjacent to, the net 48 when the detector 100 is installed at the basketball goal 40, such as to detect the presence and/or non-presence of any basketballs 60 traveling through the rim 46 to detect the made and missed shots where such a presence is detected, or undetected, respectively.

For example, without limitation, the detector 100 may comprise a housing subassembly 108 with one or more components (e.g., 108A, 108B), such as to hold, position, and protect the ultrasonic sensors 102. The housing subassembly 108 may comprise, or be attached to, a bracket 108B. The bracket 108B may be configured for selective securement to one or more portions of the basketball goal 40, such as at, over, to, or at least partially about a bracket connecting the basketball rim 46 to the backboard 44. In this fashion, the ultrasonic sensors 102 may be suspended at a position below and/or adjacent to the rim 46, such as next to any net 48 attached to the rim 46. Alternatively, or additionally, at least some of the ultrasonic sensors 102 may be positioned at or just above the rim 46. Any positioning of the ultrasonic sensors 102 may be utilized.

Figure 14:
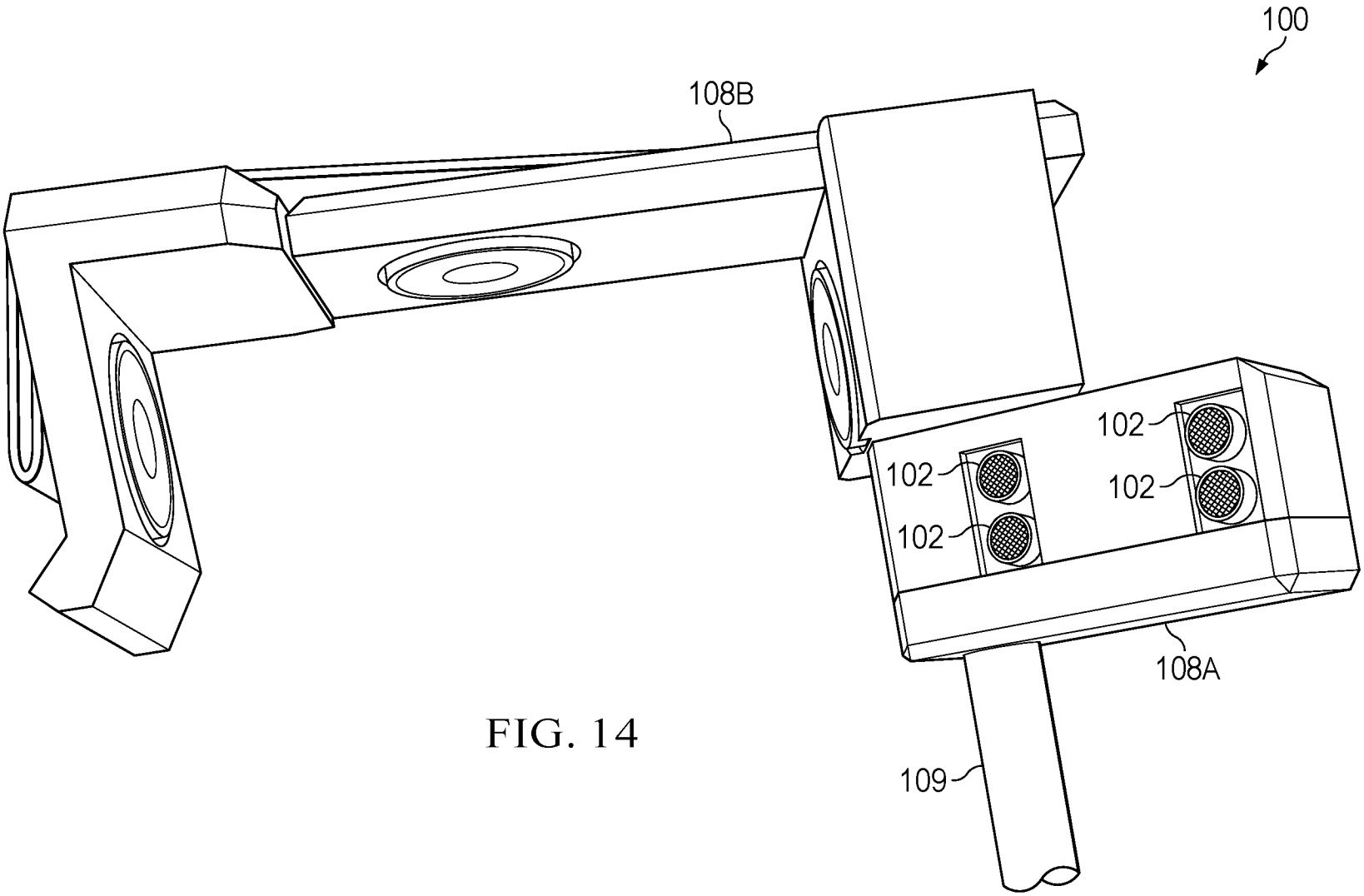
FIG. 14 is a perspective view of an exemplary embodiment of the detector, housing, and mounting pole.
Figure 15:
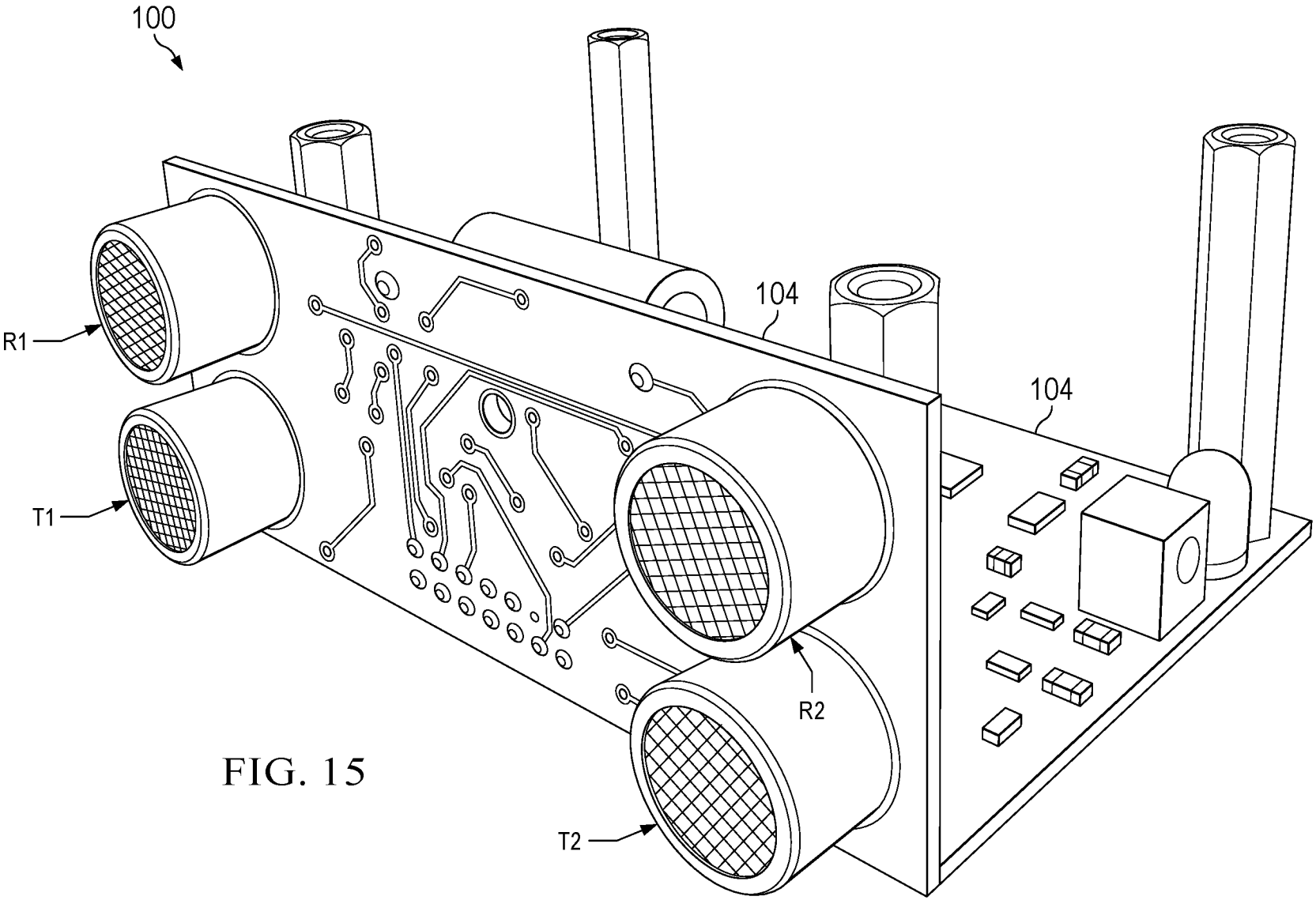
FIG. 15 is a perspective view of the detector of FIG. 14 separated from the housing and mounting pole.
Figure 16:
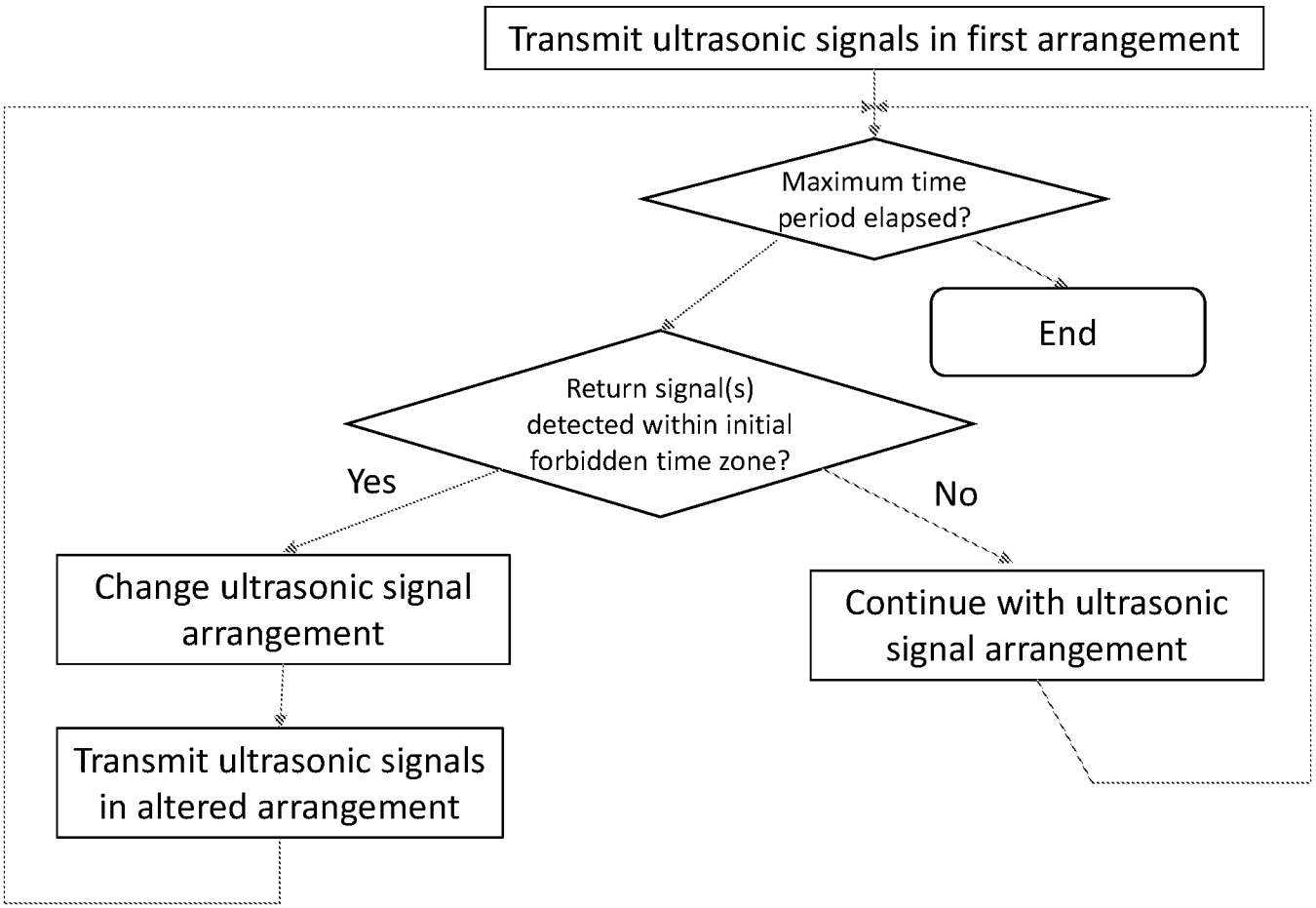
FIG. 16 is a flow chart with exemplary logic for operating the detector of FIGS. 9-15.

The housing subassembly 108 may be permanently or temporarily attached to a pole 109, such as a telescoping pole, for mounting and removing the detector 100 from the basketball goal 40 as shown with particular regard to at least FIG. 14.

Alternatively, or additionally, the detector 100 may be connected to, or be connectable to, part of the basketball launching device 10 such that the detector 100 is located in a similar position when the device 10 is positioned at the basketball goal 40. For example, without limitation, the detector 100 may be connected to, or connectable to, one or more of the support members 22 and/or the frame 20.

As illustrated with particular regard to at least FIG. 14, a first portion of the housing subassembly 108A may be provided at a non-zero angle relative to a second portion of the housing subassembly 108B. The first portion of the housing subassembly 108A may comprise the ultrasonic sensors 102. The second portion of the housing subassembly 108B may be configured for attachment to a portion of the basketball goal 40. The first and second portions of the housing subassembly 108A, 108B may be moveable relative to one another, in exemplary embodiments without limitation, such as pivotable about the pole 109.

Figure 12:
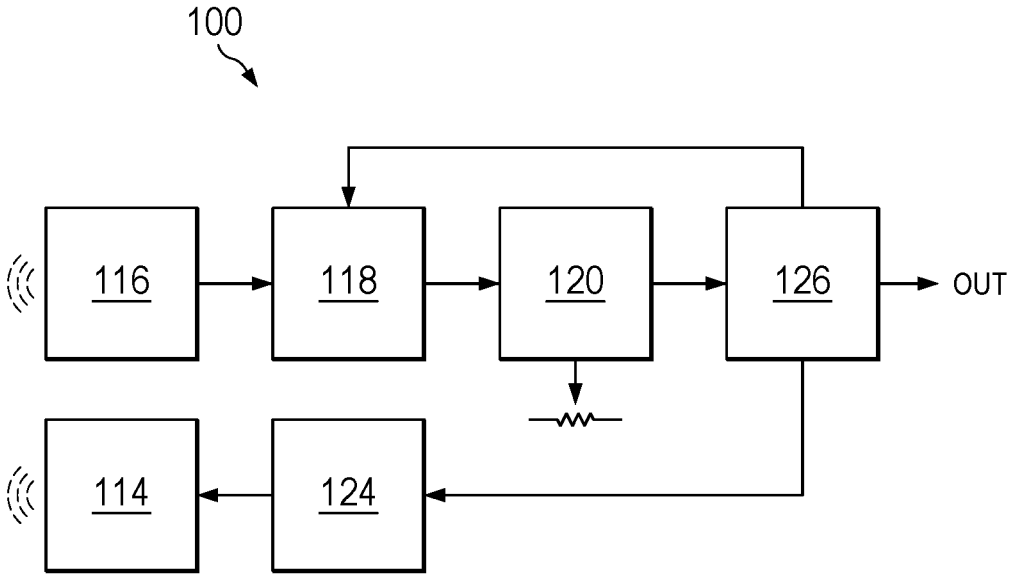
FIG. 12 is a plan view of a simplified schematic of at least an ultrasonic sensor portion of the detector of FIGS. 9-10, such as for detecting the transmissions of FIG. 11.

As illustrated with particular regard to at least FIG. 12, the receivers 116 may be electronically connected to one or more processors 126, such as by way of at least one variable gain amplifier 118 and a manual trip adjustment 120. The processor(s) 126 may be electronically connected to the transmitters 114, such as by way of at least one pulse generator 124. The processor(s) 126 may be in electronic communication with the controller(s) 68 of the device 10, or may operate as such controller(s) 68. The variable gain amplifier 118 may be utilized, such as by the processor(s) 126, to amplify weaker signals, such as those returned from further distances. Any type or level of amplification may be utilized.

The processor(s) 126 may be configured to ignore returned signals below a predetermined threshold, which may be fixed or variable, such as based on the amplification levels. The threshold may be set to ignore background noise or other irregular signals. In exemplary embodiments, without limitation, such filtering may, alternatively or additionally, be provided by the manual trip adjustment 120 which may prevent signals below the threshold from reaching the processor(s) 126.

Figure 11:
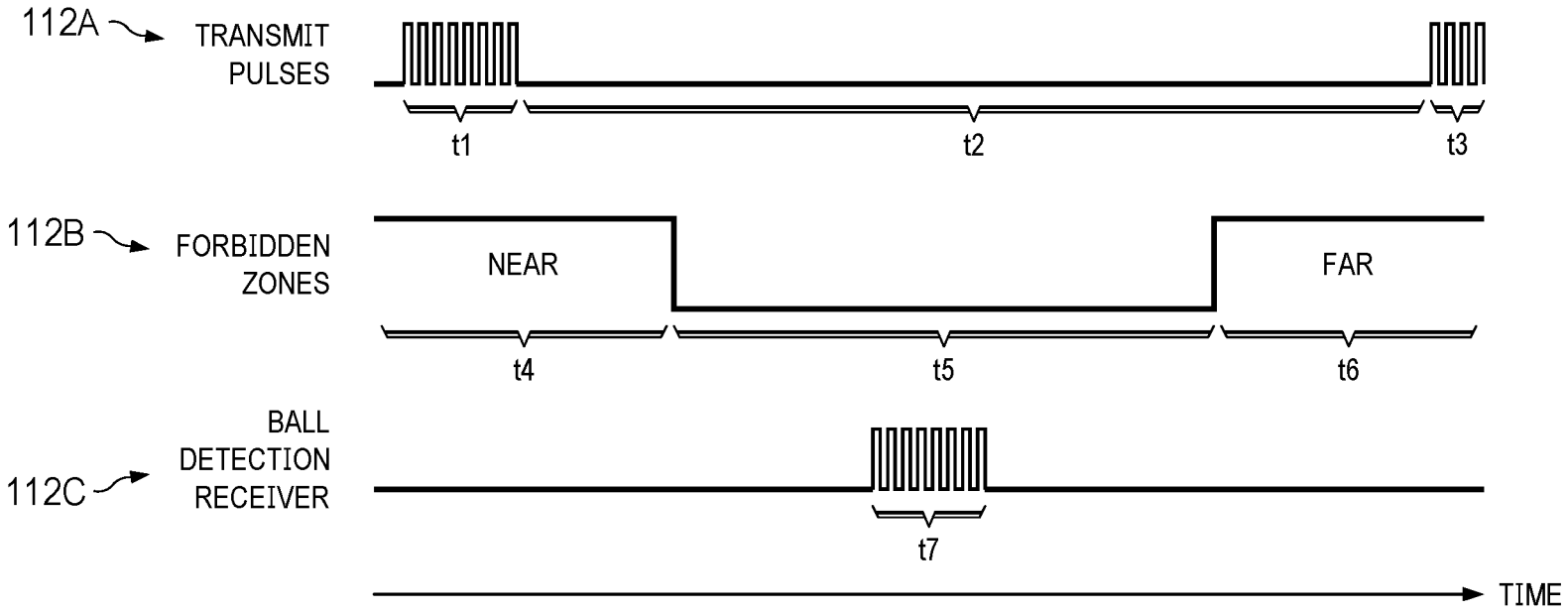
FIG. 11 is a diagram of exemplary ultrasonic signal transmission and reception time periods for use with the detector of FIGS. 9-10.

As illustrated with particular regard to at least FIG. 11, the processor(s) 126 may be configured to command the transmitters 114 of the ultrasonic sensors 102 to transmit one or more pulses, or bursts of pulses, of ultrasonic signals as generally indicated at item 112A, for example. The transmissions may be made at intervals, such as at t1 and t3 with time t2 therebetween. The receivers 116 may be configured to monitor for return of the emitted ultrasonic signals, such as due to reflection off an object or objects. In order to eliminate or reduce false positives that may be caused by the net 48, as generally indicated at item 112B, the processor(s) 126 may be configured to ignore return signals received at specific time periods, such as during a first predetermined period of time t4 occurring after emission and a second predetermined period of time t6 occurring after emission, which may be generally corresponded with the anticipated arrival of signals reflected from the near and far portions of the net 48, respectively. This may reduce or eliminate false positives. As generally indicated at item 112C, and specifically at t7, where signals are returned within a specific time period t5, which may be the time period outside the forbidden zones (e.g., t4, t6) of item 112B, the processor(s) 126 may be configured to determine that a made shot has been made. The processor(s) 126 may be configured to utilize a minimum and maximum time, essentially have a specified time range, from emission of ultrasonic signals to which the processor(s) 126 will signal a made shot based on return of reflected signals. In other exemplary embodiments, without limitation, the receivers 116 may be turned off during the forbidden zones (e.g., t4, t6) and/or only activated during the specific time period (e.g., t5).

As illustrated with particular regard to at least FIG. 23, each of the ultrasonic sensors 102 may comprise multiple transmitters 114 and receivers 116, some or all of which may be utilized in a given sensing episode in various combinations. Each of the sensors 102 may be under individual firmware control of the processor(s) 126, though such is not necessarily required. The use of multiple sensors 102 may broaden lateral coverage and may increase the ability to detect the basketballs 60 when one of the transmitters 114 and/or receivers 116 is blocked by an object, such as the net 48. This may be particularly helpful as the net 48 may sway or otherwise move during normal use, when shots are being attempted or not. Thus, one or more of the transmitters 114 and/or receivers 116 may be periodically blocked or obstructed.

The multiple transmitters 114 and receivers 116 may be utilized and/or paired in various fashions (e.g., transmitter T1 with receiver R1, transmitter T2 with receiver R2, transmitter T1 with receiver R2, transmitter T2 with receiver R1, etc.) by the processor(s) 126. Various utilizations and/or pairings may be programmed to occur during a given sensing episode, such as on a random, sequential, or the like basis. The time it takes for the basketball 60 to pass through a signaling range of the detector 100 may permit multiple combinations of the transmitters 114 and receivers 116 to be utilized. For example, without limitation, where signals are returned during the initial forbitten zone from a given one of the sensors 102 which is active, a determination may be made by the processor(s) 126 that the transmitter 114 is likely blocked and the processor(s) 126 may instead utilize a different transmitter 114 and/or receiver 116. As another example, without limitation, confirmation of detection during the specified time period may be required from multiple ones or combinations of the transmitters 114 and receivers 116, otherwise the signals may be disregarded as false positives.

The processor(s) 126 may be configured to utilize some or all of the sensors 102, or components thereof, in a given instance. The processor(s) 126 may be configured to record a made shot where return signals are received at any of the receivers 116 during the specified time period. Alternatively, or additionally, the processor(s) 126 may be configured to record a made shot only where multiple or all sensors 102 utilized record return signals during the specified time period. The receivers 116 may be inactivated and/or signals may be ignored where received during the forbidden time periods.

Figure 17:
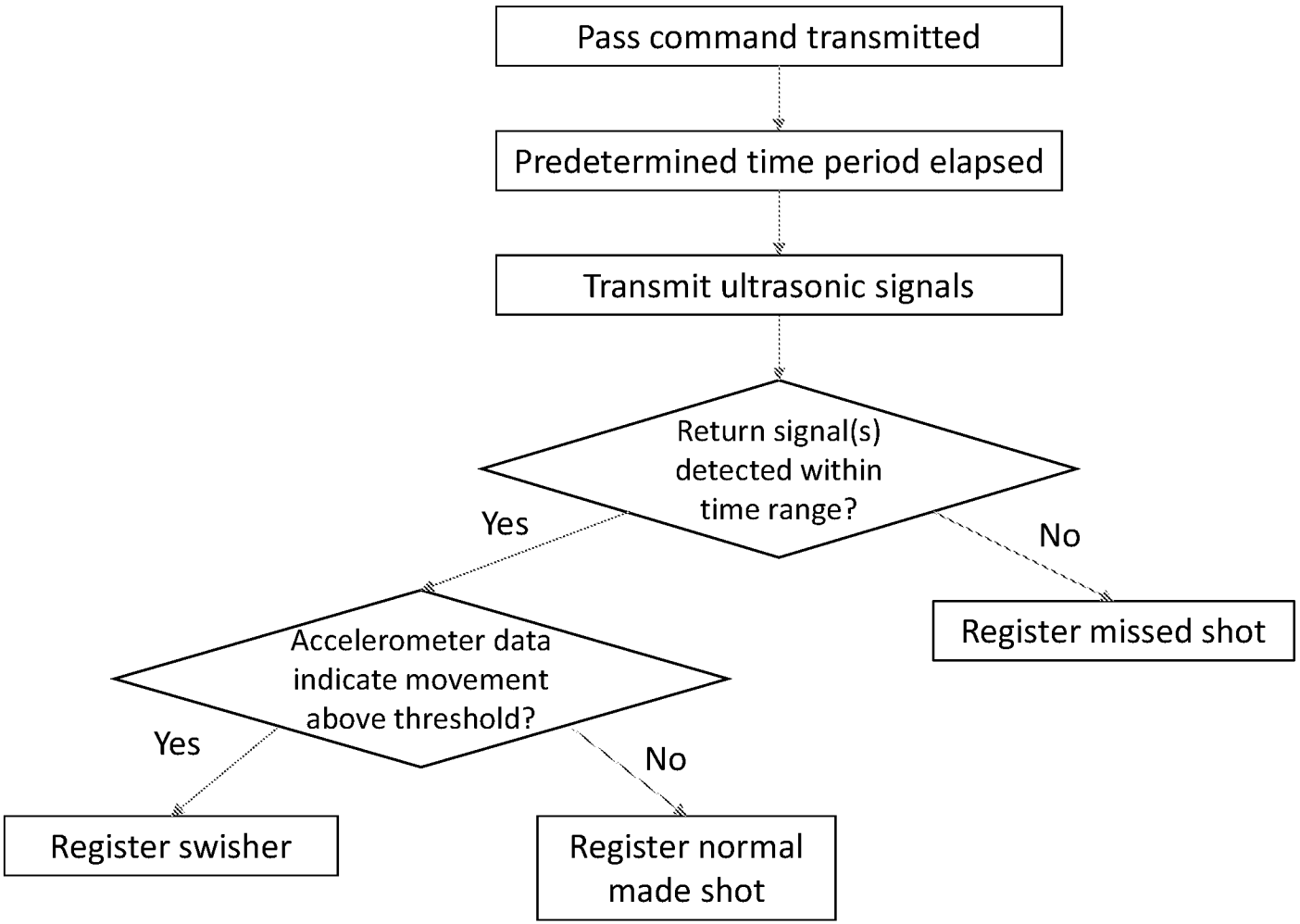
FIG. 17 is a flow chart with exemplary logic for operating the detector of FIGS. 9-16.

As illustrated with particular regard to at least FIGS. 17 and 21, in exemplary embodiments, without limitation, the detector 100 may comprise one or more accelerometer(s) 106. The accelerometer(s) 106 may be connected to the same processor(s) 126 as the ultrasonic sensor(s) 102, though such is not required. A single, three-axis accelerometer 106 may be utilized which is mounted to a circuit board 104 or other substrate, though any type, kind, number, and/or arrangement of accelerometers 106 may be utilized. In exemplary embodiments, without limitation, the accelerometer(s) 106, the processor(s) 126, and/or other component(s) may be configured to combine the reading from all axis of the accelerometer(s) 106 such that the direction of the ball hitting the rim 46 does not affect the determination of a swish or a normal made shot.

A manual trip adjustment, such as a potentiometer (digital or otherwise), may be interposed between the accelerometer(s) 106 and the processor(s) 126, and may be utilized to prevent transmission of signals below a given threshold to the processor(s) 126. Alternatively, or additionally, the processor(s) 126 may electronically filter out such signals.

Figure 13:
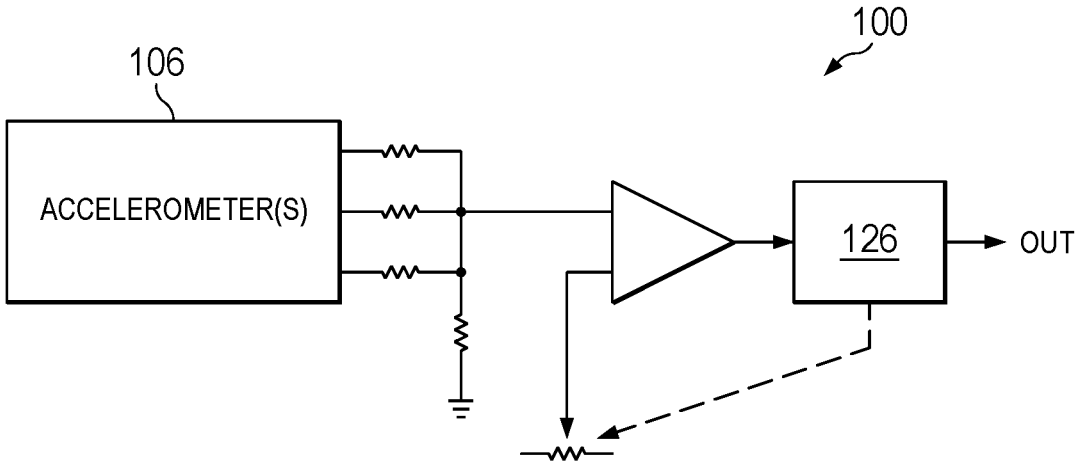
FIG. 13 is a plan view of a simplified electrical schematic for an accelerometer portion of the detector of FIGS. 9-10 and 12.

The accelerometer(s) 106 portion of the detector 100, such as shown with particular regard to at least FIG. 13, may be electronically connected to the ultrasonic sensor(s) 102 portion of the detector 100, such as shown with particular regard to at least FIG. 12, such as by way of one or more common processor(s) 126.

Data from the accelerometer(s) 106 may be fed to the processor(s) 126 to determine if a made-shot is a swish as further described herein. The accelerometer(s) 106 may be attached, directly or indirectly, to one or more of the housing(s) 108 such that movement and/or vibrations of the housings 108 are transmitted to the accelerometer(s) 106, such as upon impact of a basketball 60 at the backboard 44 and/or rim 46. Alternatively, or additionally, the accelerometer(s) 106 may be attached, directly or indirectly, to the rim 46, backboard 44, or other portion of the basketball goal 40.

As illustrated with particular regard to at least FIG. 25, where return signals during a sensing episode are returned at the appropriate time period(s) (e.g., t5), a made shot may be determined. Where no such return signals are received during such time period(s), a missed shot may be recorded. The sensing episode may begin and end during a predetermined time range (e.g., t8) following issuance of a command from the controller(s) 68 to pass a basketball 60 from the launching device 10. The issuance of such commands, or data indicating the same, may be relayed to the processor(s) 126 to initiate detection at the detector 100. Alternatively, the commands may originate at the processor(s) 126.

In exemplary embodiments, without limitation, the detector 100 and/or the ultrasonic sensor(s) 102 may only be active during the sensing episode. Alternatively, or additionally, the detector 100 may be continuously and/or periodically sensing for the basketballs 60, such as during a practice session and/or whenever powered, and data during certain time periods (e.g., during the sensing episodes) may be recognized as made or missed shots, or ignored, such as background noise.

Where one or more accelerometers 106 are utilized, movement data may be relayed to the processor(s) 126. Where the processor(s) 126 receive data from the ultrasonic sensor(s) 102 indicating a made shot, and movement data from the accelerometer(s) 106 within a given, associated time period is below a predetermined threshold, the processor(s) 126 may be configured to register a "swish". Where data from the ultrasonic sensor(s) 102 indicates a made shot, and movement data received from the accelerometer(s) 106 within the given, associated time period is above the predetermined threshold, the processor(s) 126 may be configured register a normal (non-swish) made-shot. Where no signals are returned from the ultrasonic sensor(s) 102 during the specified time, a missed shot may be recorded. The associated time period may include any period, including the sensing episode time period t8, the specified time period for detecting made shots t5, the time period between transmission bursts t2, the time period following passing of the basketball (e.g., t4 and t5) combinations thereof, or the like.

A single or multiple bursts of ultrasonic transmissions may be provided during a given sensing episode. The bursts may be provided repetitively and/or at any interval(s). Return of reflected signals during the specified time (e.g., t5) from any one of the bursts may be used to indicate a made shot. Alternatively, or additionally, return of reflected signals during the specified time from multiple ones or all of the bursts may be required to indicate a made shot.

Notably, the use of the accelerometer(s) 106 and detection of swish is optional and may not be required. For instance, the detector 100 may rely solely on the ultrasonic sensors 102 and related components and may not be configured to separate record swishes.

The detector 100, such as the processor(s) 126 thereof, may be in wired or wireless communication with the basketball launching device 10, such as the controller(s) 68 thereof. The detector 100 may comprise one or more power sources, such as but not limited to rechargeable or replaceable batteries, to provide wireless operation power.

Some or all of the steps shown and/or described herein may be repeated in any order. Such as for each pass commanded by the device 10.

In other exemplary embodiments, other types of detector(s) for detecting made shots may be provided at, or in association with, the basketball launching machine 10 in place of, or in combination with, the detector(s) 100 at the same or different locations detector(s) 100. Such detectors may comprise, for example without limitation, photo eyes, flappers, audio sensors, proximity detectors, switches, cameras (e.g., time of flight (TOF) cameras), combinations thereof, or the like. Such detectors may be provided on the basketball launching machine 10, such as on the frame 20, the housing 16, combinations thereof, or the like. Alternatively, or additionally, such detectors may be in electronic communication with the basketball launching machine 10 or components thereof, the electronic devices 70, combinations thereof, or the like such as but not limited to, by way of wired or wireless connections. Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing device. The electronic devices may comprise personal computers, smartphone, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein. The electronic devices, including but not necessarily limited to the electronic storage devices, databases, controllers, or the like, may comprise and/or be configured to hold, solely non-transitory signals.

What is claimed is:

1. A system for automatically detecting made and missed basketball shots using ultrasonics, said system comprising:

a launcher for passing basketballs to locations about a basketball playing area having a basketball goal;

a detector for selective positioning below and adjacent to a rim of the basketball goal, said detector comprising one or more ultrasonic sensors, one or more processors, and one or more electronic storage devices, wherein said one or more processors are in electronic connection with each of the one or more ultrasonic sensors, and said one or more electronic storage devices comprise software instructions, which when executed, configure the one or more processors to:

command the one or more ultrasonic sensors to transmit ultrasonic signals;

monitor for reflections of the transmitted ultrasonic signals occurring within a specified time period after transmission which excludes an initial time period after transmission and time after the specified time period; and record a made shot where reflections of the transmitted ultrasonic signals are detected within the specified time period.

2. The system of claim 1 wherein:

said one or more electronic storage devices comprise software instructions, which when executed, configure the one or more processors to record a missed shot where no reflections of the transmitted ultrasonic signals are detected within the specified time period.

3. The system of claim 1 further comprising:

a controller for the launcher, wherein the one or more processors are in electronic communication with the controller, and wherein said one or more electronic storage devices comprise software instructions, which when executed, configure the one or more processors to command the multiple ultrasonic sensors to transmit the ultrasonic signals following receipt of data form the controller indicating initiation of a pass command for the launcher.

4. The system of claim 1 wherein:

the detector comprises a housing subassembly at least each of the one or more ultrasonic sensors and the one or more processors; and the housing subassembly is configured for selective connection to a bracket extending between the rim of the basketball goal and a backboard.

5. The system of claim 1 wherein:

the detector comprises a variable gain amplifier and a manual trip adjustment for each receiver of the one or more ultrasonic sensors; and the detector comprises a pulse generator for each transmitter of the one or more ultrasonic sensors.

6. The system of claim 1 wherein:

said one or more ultrasonic sensors comprise multiple ultrasonic sensors.

7. The system of claim 6 wherein:

said one or more electronic storage devices comprise software instructions, which when executed, configure the one or more processors to command each of the multiple ultrasonic sensors to transmit the ultrasonic signals by:

utilizing a first arrangement of the multiple ultrasonic sensors for a first set of the bursts; and utilizing a second arrangement of the multiple ultrasonic sensors for a second set of the bursts.

8. The system of claim 7 wherein:

said one or more electronic storage devices comprise software instructions, which when executed, configure the one or more processors to move from the first arrangement of the multiple ultrasonic sensors to the second arrangement of the multiple ultrasonic sensors when reflections of the first set of the bursts are detected within the initial time period after transmission.

9. The system of claim 7 wherein:

the first arrangement of the multiple ultrasonic sensors comprises utilizing only a first one of the multiple ultrasonic sensors; and the second arrangement of the multiple ultrasonic sensors comprises utilizing only a second one of the multiple ultrasonic sensors.

10. The system of claim 7 wherein:

the first arrangement of the multiple ultrasonic sensors comprises utilizing all of the multiple ultrasonic sensors, with a first receiver paired with a second transmitter and a second receiver paired with a first transceiver; and the second arrangement of the multiple ultrasonic sensors comprises utilizing all of the multiple ultrasonic sensors, with a second receiver paired with a first transmitter and a first receiver paired with a second transceiver.

11. The system of claim 6 wherein:

each of the multiple ultrasonic sensors comprise at least one transmitter and at least one receiver mounted to a circuit board such that the receivers are placed vertically above a respective one of the transmitters.

12. The system of claim 1 wherein:

the detector comprises at least one accelerometer; and said one or more electronic storage devices comprise software instructions, which when executed, configure the one or more processors to:

monitor for motion data from the at least one accelerometer; and where a made shot is recorded and motion data within a predetermined time period of commanding the one or more ultrasonic sensors to transmit the ultrasonic signals is detected which is below a predetermined threshold, record the made shot as a swish.

13. The system of claim 12 wherein:

said one or more electronic storage devices comprise software instructions, which when executed, configure the one or more processors to, where a made shot is recorded and motion data within the predetermined time period of commanding the one or more ultrasonic sensors to transmit the ultrasonic signals is detected which is above the predetermined threshold, record the made shot as a normal made shot.

14. The system of claim 1 further comprising:

a structural subassembly, wherein the launcher is connected to the structural subassembly, and the detector is not physically connected to the structural subassembly such that the detector is independently movable from the structural assembly and in wireless electronic communication with the controller, or the detector is not physically connected to the structural subassembly such that the detector is independently movable from the structural assembly aside from a wired connection to the controller.

15. A detector for automatically detecting made and missed basketball shots using ultrasonics, said detector comprising:

a housing subassembly configured for selective attachment to a portion of a basketball goal;

multiple ultrasonic sensors configured to be placed below and adjacent to a rim of said basketball goal when said housing subassembly is attached to said portion of said basketball goal;

one or more processors in electronic connection with each of the multiple ultrasonic sensors; and one or more electronic storage devices comprising software instructions, which when executed, configure the one or more processors to:

command the multiple ultrasonic sensors to transmit bursts of ultrasonic signals at various times;

monitor for reflections of the transmitted bursts occurring within a respective specified time period after a respective transmission, wherein each of said specified time periods excludes an initial time period after the respective transmission and time after the respective specified time period; and record made shots where reflections of the transmitted bursts are detected within the respective specified time period.

16. The detector of claim 15 wherein:

the detector comprises a housing subassembly for at least the multiple ultrasonic sensors and the one or more processors; and the housing subassembly is configured for selective connection to a bracket extending between the rim of the basketball goal and a backboard.

17. The detector of claim 15 wherein:

the detector comprises a variable gain amplifier and a manual trip adjustment for each receiver of the multiple ultrasonic sensors; and the detector comprises a pulse generator for each transmitter of the multiple ultrasonic sensors.

18. The detector of claim 15 wherein:

said one or more electronic storage devices comprise software instructions, which when executed, configure the one or more processors to command the multiple ultrasonic sensors to transmit the bursts of the ultrasonic signals by:

utilizing a first arrangement of the multiple ultrasonic sensors for a first set of the bursts; and utilizing a second arrangement of the multiple ultrasonic sensors for a second set of the bursts.

19. The detector of claim 15 wherein:

the detector comprises at least one accelerometer; and said one or more electronic storage devices comprise software instructions, which when executed, configure the processor to:

monitor for motion data from the at least one accelerometer;

where a made shot is recorded and motion data is detected within a predetermined time period of commanding the multiple ultrasonic sensors to transmit at least a respective one of the bursts which is below a predetermined threshold, record the made shot as a swish; and where a made shot is recorded and motion data is detected within the predetermined time period of commanding the multiple ultrasonic sensors to transmit at least a respective one of the bursts which is above the predetermined threshold, record the made shot as a normal made shot.

20. A basketball launching device with a detector for automatically detecting made and missed basketball shots using ultrasonics, said basketball launching device comprising:

a structural subassembly;

a launcher connected to said structural subassembly and configured to pass basketballs to locations about a basketball playing area having a basketball goal;

a controller in electronic communication with the launcher; and the detector, wherein the detector is configured to be selectively attached to a portion of the basketball goal such that multiple ultrasonic sensors, each comprising at least one transmitter and at least one receiver, are positioned below and adjacent to a rim of the basketball goal, said detector comprising, one or more processors in electronic connection with the controller, each of the multiple ultrasonic sensors, and one or more electronic storage devices, wherein said one or more electronic storage devices comprise software instructions, which when executed, configure the one or more processors to:

receive data indicating that the controller has issued a command to the launcher to pass a basketball;

command the multiple ultrasonic sensors to transmit a burst of ultrasonic signals during a sensing episode time period following the receipt of the data;

monitor for reflections of the transmitted burst occurring within a specified time period of the sensing episode time period, wherein said specified time period excludes an initial time period after transmission of the burst and time after the specified time period; and record a made shot where at least one reflection of the transmitted burst is detected within the specified time period.

21. The basketball launching device of claim 20 wherein:

the detector comprises at least one accelerometer; and said one or more electronic storage devices comprise software instructions, which when executed, configure the one or more processors to:

monitor for motion data from the at least one accelerometer; and where a made shot is recorded and motion data within a predetermined time period of the sensing episode time period is detected which is below a predetermined threshold, record the made shot as a swish.

* * * * *